US007832665B2

(12) United States Patent
Buonfiglio

(10) Patent No.: US 7,832,665 B2
(45) Date of Patent: Nov. 16, 2010

(54) TENSION ADJUSTMENT GAUGE SYSTEM AND METHOD FOR BALL AND RING COAL PULVERIZER

(75) Inventor: Richard Buonfiglio, Salem, MA (US)

(73) Assignee: Dominion Resources, Inc., Richmond, VA (US)

( * ) Notice: Subject to any disclaimer, the term of this patent is extended or adjusted under 35 U.S.C. 154(b) by 176 days.

(21) Appl. No.: 12/237,871

(22) Filed: Sep. 25, 2008

(65) Prior Publication Data

US 2009/0084875 A1 Apr. 2, 2009

Related U.S. Application Data

(60) Provisional application No. 60/976,278, filed on Sep. 28, 2007.

(51) Int. Cl.
*B02C 15/12* (2006.01)

(52) U.S. Cl. ..... 241/25; 241/37; 241/101.3; 241/103; 241/290

(58) Field of Classification Search ..... 241/25, 241/58, 103, 101.3, 290, 117, 37
See application file for complete search history.

(56) References Cited

U.S. PATENT DOCUMENTS 2,595,587 A * 5/1952 Leach ..... 241/58
6,609,669 B2 * 8/2003 Rakocy et al. ..... 241/103

* cited by examiner

*Primary Examiner*—Mark Rosenbaum
(74) *Attorney, Agent, or Firm*—McGuirewoods, LLP

(57) ABSTRACT

A tension adjustment gauge system and method for a ball and ring coal pulverizer is provided that includes a housing, a stationary top grinding ring within the housing, a rotating lower grinding ring within the housing, a plurality of grinding balls between the top grinding ring and the lower grinding ring, an adjustable loading system for applying a compressive force exerted on the top grinding ring and grinding balls against the lower grinding ring. The adjustable loading system includes a single hydraulic assembly mounted on the upper portion of the housing, a gauge mounted to the hydraulic assembly for determining linear movement of a piston of the hydraulic assembly, a plurality of threaded rods mounted to the upper portion of the housing capable of being manually adjusted. The movement of the piston corresponds to an equal distance of movement of a spring gap between an upper and lower portion of the compression spring, such that the gauge indicates the change in the spring gap by moving the piston. The tension adjustment gauge system is more efficient and less time consuming to perform tension adjustments to the ball and ring coal pulverizer.

19 Claims, 34 Drawing Sheets

TENSION ADJUSTMENT GAUGE SYSTEM AND METHOD FOR BALL AND RING COAL PULVERIZER

CROSS-REFERENCE TO RELATED APPLICATIONS

This application claims benefit of U.S. Provisional Patent Application 60/976,278, filed Sep. 28, 2007, entitled TENSION ADJUSTMENT GAGE SYSTEM AND METHOD FOR BALL AND RING COAL PULVERIZER, the disclosure of which is incorporated by reference herein in its entirety.

FIELD OF THE INVENTION

The invention relates generally to coal pulverizers for grinding combustion fuels, such as coal, and more particularly, to a tension adjustment loading apparatus, system and method for a grinding ring of a ball and ring pulverizer, such as, for example, an E and EL coal pulverizer made by The Babcock & Wilcox Company.

BACKGROUND OF THE INVENTION

Coal pulverizers are typically used to grind, dry and classify raw chunks of coal into fine solids which can be fluidized and fed, for example, to burners used in conjunction with industrial or utility boilers or furnaces. As is known to those skilled in the art, several different types of coal pulverizers, or coal mills, exist today, including those known by the designations "E" or "EL."

EL type pulverizers are ball-and-ring (or ball-and-race) type pulverizers which employ the ball-bearing principle to grind the coal. EL pulverizers were first produced in the early 1950's. Conventional E and EL pulverizers use two vertical axis, horizontal grinding rings, and a set of balls placed between the grinding rings. The lower or bottom grinding ring rotates through connection to a rotating, vertical main shaft, while the upper or top grinding ring remains stationary and is spring loaded to create grinding pressure.

The coal may be ground by contact with the upper and lower grinding rings and balls (collectively, the grinding elements). The lower and upper grinding rings create a matching track that engages the balls. The force from the upper grinding ring pushes the balls against the coal layer on the lower grinding ring. The grinding rings and the balls are made of abrasion resistant alloys and comprise the major wear parts of the mill. Ground coal is swept from the grinding zone defined by the grinding rings and the balls by air for final particle size classification and subsequent pneumatic transport to one or more coal burners. Further details of EL type pulverizers are discussed in Chapter 12 of "Steam/Its Generation and Use," 40th Edition, Stultz and Kitto, Eds., Copyright 1992, The Babcock & Wilcox Company, which is hereby incorporated by reference as though fully set forth herein.

EL mill top grinding rings have historically been loaded by using up to six single load coil springs. Measurement data necessary for spring adjustments require the pulverizer to be taken off line and opened to allow access to the grinding elements. Spring adjustments are then made manually with a wrench on a screw adjustment. Accordingly, it is desirable to provide a system for adjusting the load springs which reduces the time and complexity in adjusting the load springs to accommodate for wear on the grinding balls.

SUMMARY OF THE INVENTION

In view of the foregoing, the invention includes providing a mechanical system for acquiring the necessary measurement data, efficiently and easily, without the need to open the pulverizer doors for making the necessary adjustments to the remaining load springs to accommodate for wear on the grinding balls.

In an aspect of the invention, a ball and ring coal pulverizer is provided including a housing, a stationary top grinding ring within the housing, a lower grinding ring within the housing, a plurality of grinding balls between the top grinding ring and the lower grinding ring, an adjustable loading system for applying a compressive force exerted on the top grinding ring and grinding balls against the lower grinding ring, the adjustable loading system including a single hydraulic assembly mounted on the upper portion of the housing, a gauge mounted proximate the hydraulic assembly for determining linear movement of a piston of the hydraulic assembly, a plurality of threaded rods mounted to the upper portion of the housing capable of being manually adjusted, the piston of the single hydraulic assembly passing through the upper portion of the housing to a compression spring connected to the top grinding ring, the threaded rods passing through the upper portion of the housing to a plurality of compression springs, each compression spring connected between the threaded rods and the top grinding ring and wherein movement of the piston corresponds to an equal distance of movement of a spring gap between an upper and lower portion of the compression spring, such that the gauge indicates the change in the spring gap by moving the piston.

In another aspect, a ball and ring coal pulverizer is provided including a top grinding ring within a housing, a lower grinding ring within the housing, a plurality of grinding balls between the top grinding ring and the lower grinding ring, an adjustable loading system for applying a compressive force exerted on at least one of the top grinding ring and the lower grinding ring to apply pressure against the grinding balls, the adjustable loading system including a single hydraulic assembly proximate to one of the grinding rings, a gauge mounted proximate the hydraulic assembly for determining linear movement of a piston of the hydraulic assembly, a plurality of rods configured to be manually adjusted and located to apply pressure to at least one of the grinding rings, and the piston of the single hydraulic assembly configured to apply pressure to a compression spring connected to one of the grinding rings, wherein movement of the piston corresponds to an equal distance of movement of a spring gap between an upper and lower portion of the compression spring, such that the gauge indicates the change in the spring gap by moving the piston.

In another aspect of the invention, a system for adjusting the load on a grinding ring and grinding balls of a ball and coal pulverizer is provided including means for activating a single hydraulic assembly attached to a single compression spring on a grinding ring until a desired force is achieved, means for determining a spring gap of the single compression spring corresponding to the desired force and means for adjusting compression of a plurality of corresponding compression springs to achieve the spring gap in the plurality of corresponding compression springs as the spring gap of the single compression spring.

In yet another aspect, a method for adjusting the load on a grinding ring and grinding balls of a ball and coal pulverizer is provided including activating a single hydraulic assembly attached to a single compression spring on a grinding ring until a desired force is achieved for applying an operative pressure on the grinding balls, determining the spring gap of the single compression spring corresponding to the desired force and adjusting a plurality of rods attached to a plurality of corresponding compression springs to achieve the same spring gap in the plurality of corresponding compression springs as the spring gap of the single compression spring.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

DETAILED DESCRIPTION OF THE INVENTION

Figure 1:
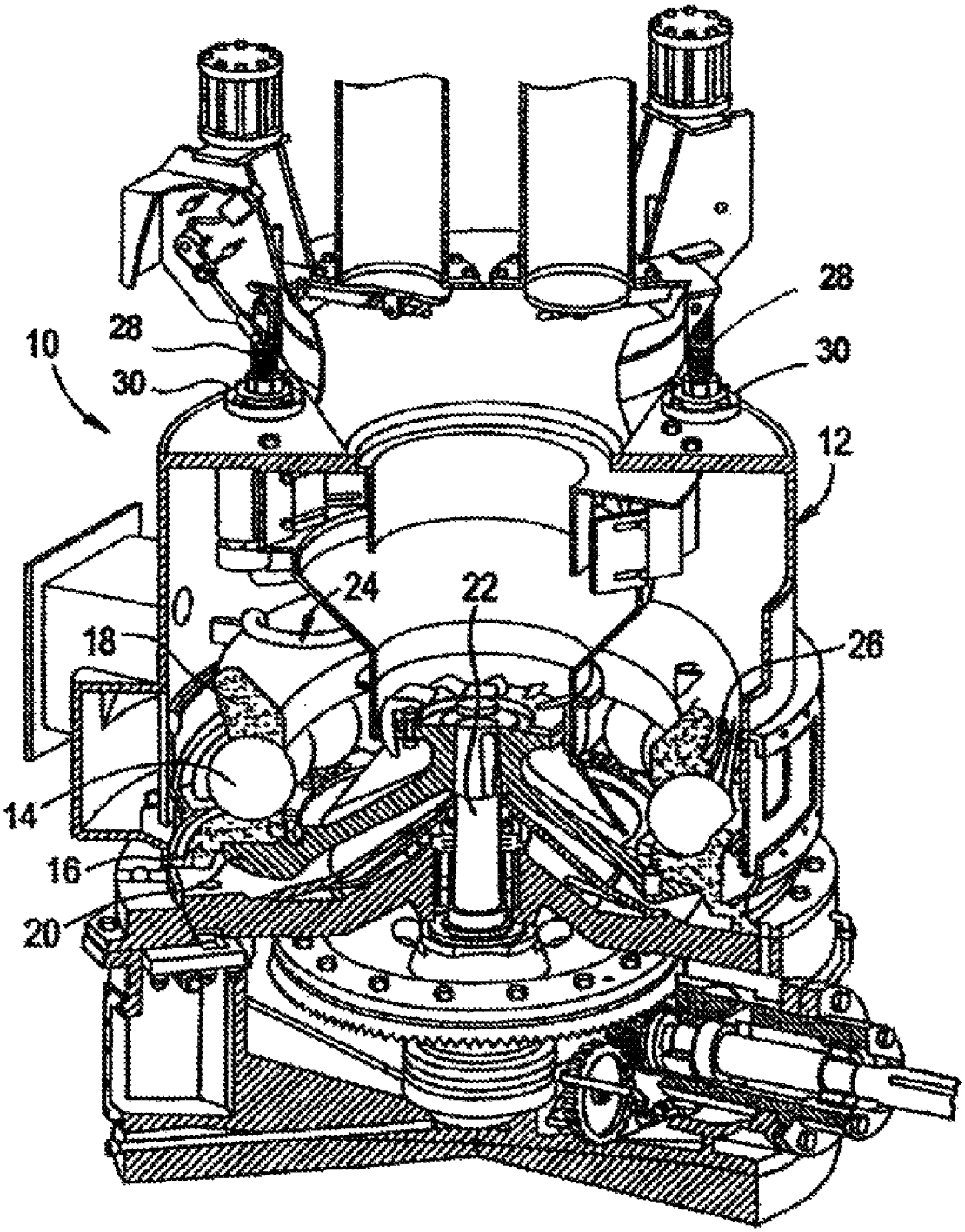
FIG. 1 (Prior Art)
FIG. 1 is a cross-sectional, perspective view of a conventional EL pulverizer.

It is understood that the invention is not limited to the particular methodology, protocols, etc., described herein, as these may vary as the skilled artisan will recognize. It is also to be understood that the terminology used herein is for the purpose of describing particular embodiments only, and is not intended to limit the scope of the invention. It is also to be noted that as used herein and in the appended claims, the singular forms "a," "an," and "the" include the plural reference unless the context clearly dictates otherwise.

Unless defined otherwise, all technical and scientific terms used herein have the same meanings as commonly understood by one of ordinary skill in the art to which the invention pertains. The embodiments of the invention and the various features and advantageous details thereof are explained more fully with references to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals reference similar parts throughout the several views of the drawings.

Referring to the drawings, FIG. 1 illustrates a perspective view of a conventional EL pulverizer 10 for grinding incoming material, such as coal. The grinding or crushing of coal in the EL pulverizer 10 is conducted within a pulverizer housing 12. The pulverizer housing 12 contains a plurality of pulverizer balls 14, which are resting in a track established between a bottom grinding ring 16 and a top grinding ring 18. The balls 14, bottom grinding ring 16 and top grinding ring 18 comprise the grinding mechanism of an EL pulverizer 10, and require periodic replacement due to the abrasive nature of the raw coal. The lower grinding ring 16 rests on top of a pulverizer yoke 20, which rotates about a vertical axis established by the gearbox main shaft 22 and yoke 20 of the EL pulverizer 10. The upper grinding ring 18 is subjected to an external loading force required for grinding the coal by springs 24. The outside diameter of the upper grinding ring 18 comprises "flutes" 26, which provide primary circulation of partially ground coal in the grinding mechanism, and which also provide tracking forces to the pulverizer balls 14 to allow concentric rotation and orbiting of the balls 14 in the track of the upper grinding ring 18 and lower grinding ring 16. Tension of the grinding mechanism is adjusted by screw-down bolts 28 that pass through brackets 30 attached to the top of the housing 12.

Figure 2:
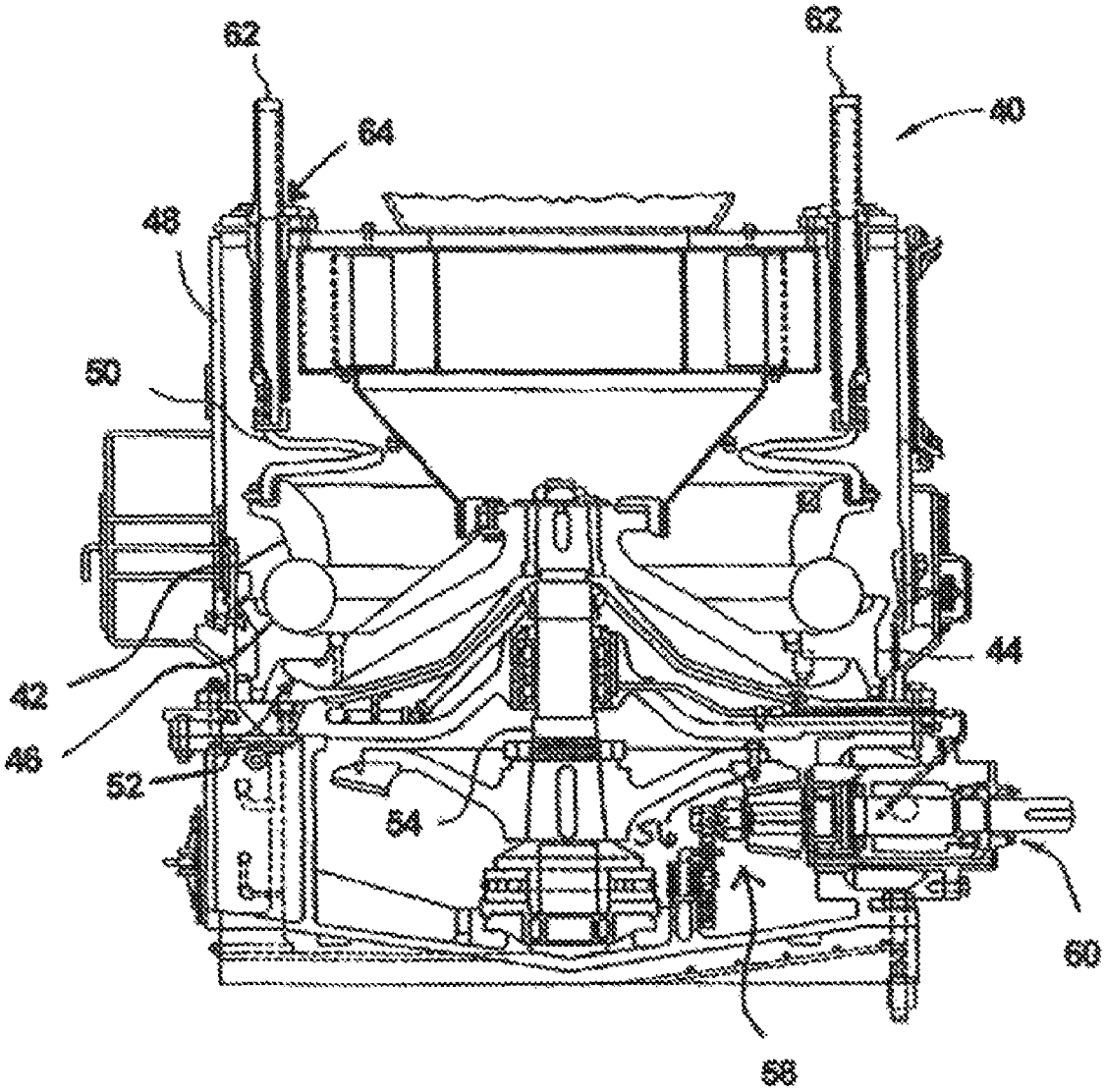
FIG. 2 (Prior Art)
FIG. 2 is a partial sectional view of a known loading system for a typical Babcock & Wilcox ball and ring pulverizer.

FIG. 2 is a partial sectional view of a known loading system for a typical Babcock & Wilcox ball and ring pulverizer. The pulverizer 40 has a stationary top ring 42, one rotating bottom ring 44, and one set of balls 46 that comprise the grinding elements. The pulverizer 40 includes a cylindrical housing 48. The pressure required for efficient grinding is obtained from externally adjustable springs 50. The bottom ring 44 is driven by a yoke 52 which is attached to a vertical main shaft assembly 54 of the pulverizer 40. The top ring 42 is loaded by the springs 50 which provide the desired grinding pressure and hold the top ring 42 stationary. Raw coal is fed into the grinding zone where it mixes with partially ground coal that forms a circulating load. Pulverizer air causes the coal to circulate through the grinding elements where some of it is pulverized in each pass through the row of balls 46. As the coal becomes fine enough to be picked up by the air conveyed into the pulverizer 40 around the perimeter of the bottom ring 44, it is carried to the classifier where coal of a desired fineness is separated from the stream of air and pulverized coal, and is carried out with the air. Oversized material is returned to the grinding zone.

The pulverizer 40 is driven by bevel gears 56 provided on the underside of the bottom ring 44 which engage corresponding bevel gear teeth 58 on horizontal pinion shaft 60 provided in the base of the pulverizer 40. Both the vertical main shaft 54 and the horizontal pinion shaft 60 are mounted in roller bearings. Forced lubrication is provided for the entire gear drive by an oil pump submerged in the oil reservoir and gear-driven from the pinion shaft 60.

Further details of EL pulverizers may be found in Chapter 12 of "Steam/Its Generation and Use," 40th Edition, Stultz and Kitto, Eds., Copyright 1992, The Babcock & Wilcox Company, which is hereby incorporated by reference as though fully set forth herein.

One of the main requirements for grinding coal in an EL pulverizer is adequate loading on the grinding elements. EL pulverizer top grinding rings have historically been loaded, and horizontal/rotational movement restricted, by using up to six single-coil, dual purpose springs 50. The springs 50 apply a predetermined grinding pressure, as dictated by the grindability of the fuel and fineness required, to the non-rotating top ring 42. The springs 50 also permit vertical movement of the top ring 42 to compensate for variations in size of pieces of fuel and any foreign material that might pass through the grinding elements. Additionally, the springs 50 prevent rotation of the top ring 42, and by eliminating rubbing of contact surfaces, thereby may reduce pulverizer maintenance. As the grinding elements wear, the pressure may be restored by adjusting screw-down bolts 62 that pass through brackets 64 attached to the top of the housing 48.

Figure 3:
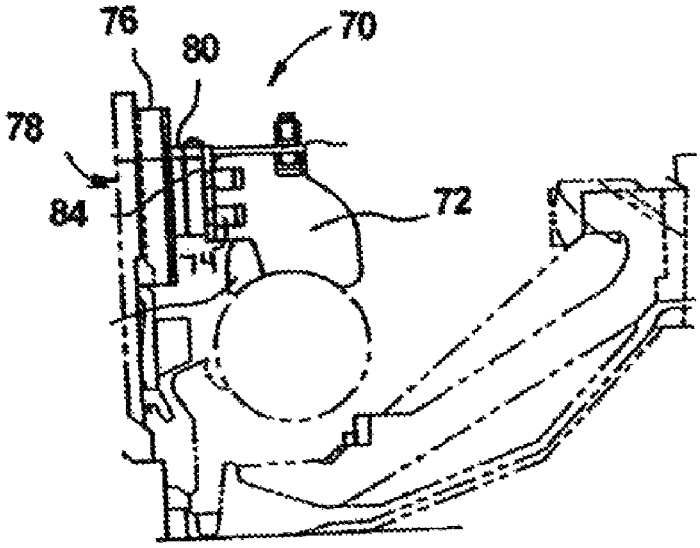
FIG. 3 (Prior Art)
FIG. 3 is a cross-sectional view of a conventional EL pulverizer grinding mechanism and snubbers.
Figure 4:
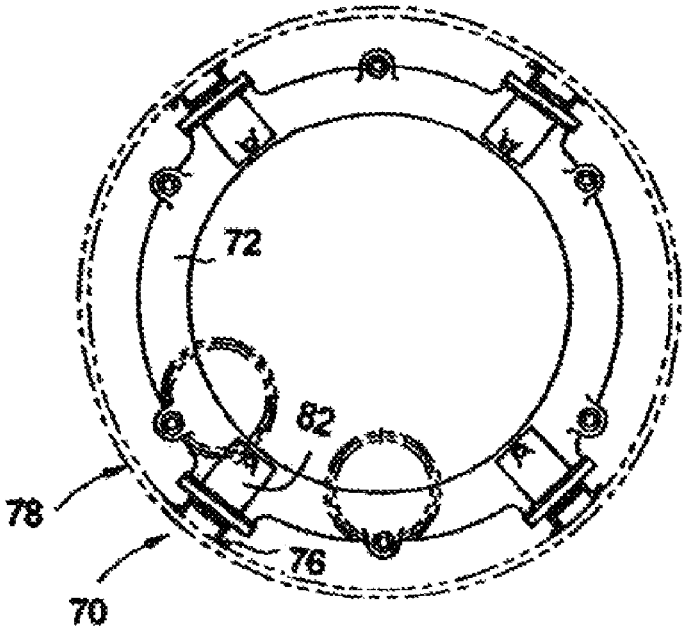
FIG. 4 (Prior Art)
FIG. 4 is a plain view of a portion of FIG. 3 showing the grinding mechanism with top grinding ring snubbers.

FIG. 3 is a cross-sectional view of a conventional EL pulverizer grinding mechanism and snubbers. FIG. 4 is a plain view of a portion of FIG. 3 showing the grinding mechanism with top grinding ring snubbers. Snubbers 70 typically are either bolted or welded to the top grinding ring 72 by means of soft steel inserts 74 embedded into the hard, wear-resistant parent material of the top grinding ring 72. The convention design includes a plurality of snubbers 70, typically four in number, located and equally spaced around the circumference of the pulverizer housing 78. Each snubber 70 comprises a snubber bracket 76 attached to the pulverizer housing 78, a snubber block 80, a snubber frame 82 attached to the existing top grinding ring 72 with necessary fasteners, and a snubber shim pack 84 that allowed the clearance between the snubber block 80 and snubber bracket 76 to be reduced.

Figure 5:
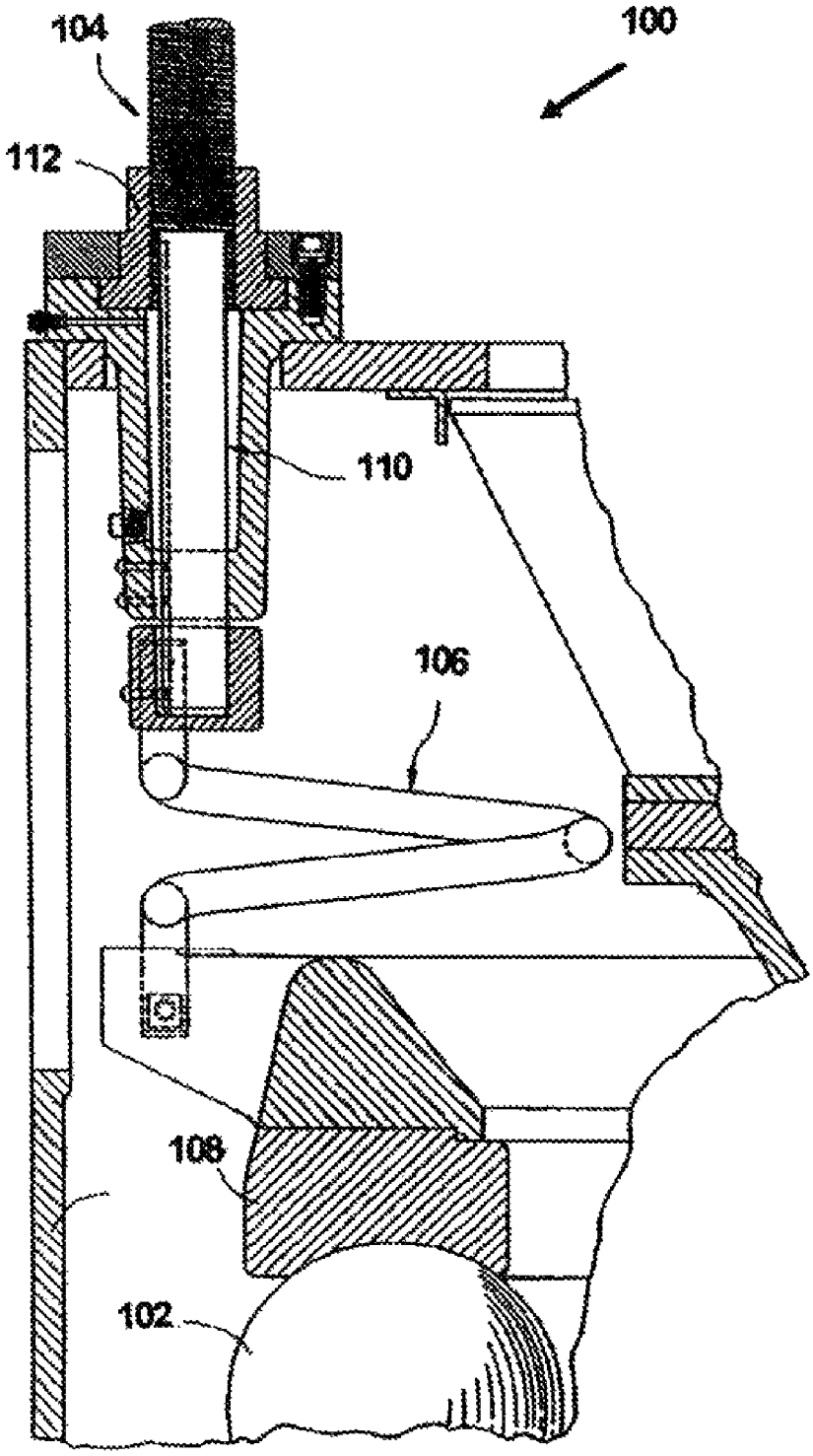
FIG. 5 (Prior Art)
FIG. 5 is a sectional side elevation view of a prior art manually adjusted spring loading system in an EL pulverizer.

FIG. 5 is a sectional side elevation view of a prior art manually adjusted spring loading system in an EL pulverizer. FIG. 5 also illustrates a known grinding mechanism 100 for applying a load to the grinding balls 102 of a ball and ring pulverizer as taught in U.S. Pat. No. 2,595,587 to Lester L. Leach and assigned to The Babcock & Wilcox Company, which is hereby incorporated by reference as though fully set forth herein. The grinding mechanism 100 has a set of spring loading assemblies 104 connected to the compression springs 106 for applying the load to the top grinding ring 108. Individual threaded rods 110 and captive nuts 112 in each of the spring loading assemblies 104 are used to adjust the load applied to each spring 106. The compression spring 106 of each spring loading assembly 104 is loaded individually by rotating the associated captive nut 112 to move the threaded rod 110 vertically, thereby increasing or decreasing the degree of load applied to each compression spring 106.

Maintaining the proper load (i.e., an operative pressure) on the grinding elements of ball and ring pulverizers may be important to their effective operation. As the balls and rings wear, the top ring 108 moves closer to the rotating bottom ring, and the loading spring 106 compression relaxes, impacting operative pressure and reducing the grinding force. The force reduction in turn causes a drop in the pulverizer capacity and coal fineness. With the grinding mechanism described above, the pressure exerted upon the grinding elements can be suitably adjusted to compensate for the ring and ball wear without altering the restraining forces exerted by the springs 106 in a plane normal to the coil axes of springs 106. Each set of compression springs 106 and spring loading assemblies 104, however, must be individually loaded and calibrated with the remaining sets to ensure that an even loading is provided on the top grinding ring 108 and balls 102.

With conventional spring loading assemblies, the coal pulverizer must typically be shut down and opened in order to reset the compression on the springs 106 and ensure even operation of the coal pulverizer. Typically, large tools must be used to turn the captive nut 112 and adjust the loading in a time-consuming procedure. The procedure usually requires workers to be on top of the pulverizer to make some of the adjustments as well, creating a risk of injury to the worker.

Figure 6:
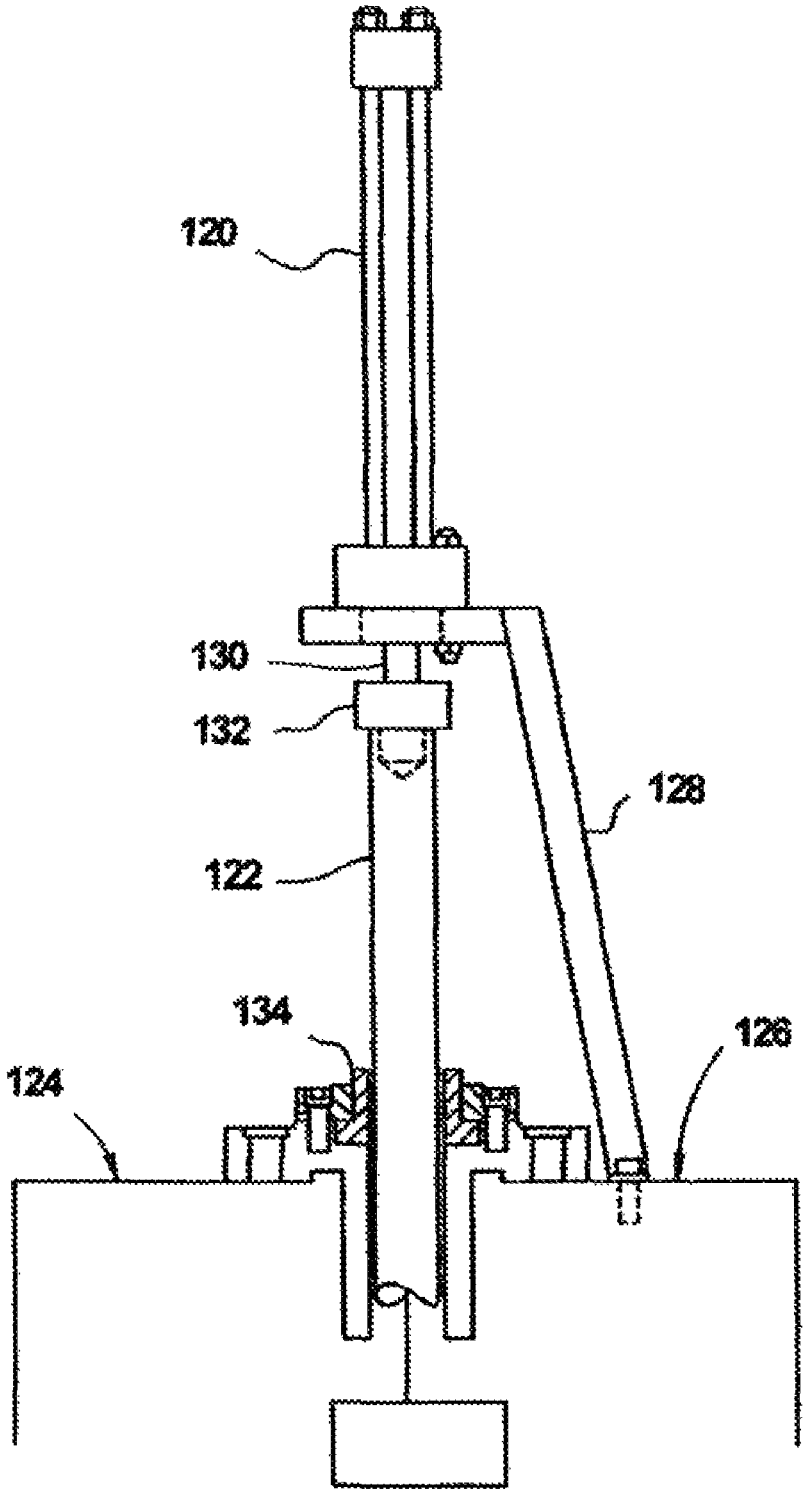
FIG. 6 (Prior Art)
FIG. 6 is a sectional side elevation view of a prior art hydraulic cylinder and rod in an EL pulverizer.

FIG. 6 is a sectional side elevation view of a prior art hydraulic cylinder and rod in an EL pulverizer. FIG. 6 shows the connections between a prior art hydraulic cylinder and piston assembly 120 and non-threaded rod 122 with the upper portion 124 of a pulverizer housing 126. Hydraulic cylinder and piston assembly 120 is supported above the non-threaded rod 122 by support means 128, advantageously a tripod attached to the upper portion 124, to hold it vertically above the pulverizer housing 126. Non-threaded rod 122 is secured to the end 130 of the hydraulic cylinder and piston assembly 120 by a linear alignment coupling 132. The non-threaded rod 122 passes sealably through upper portion 124 of the housing 126 via rod seal 134. The lower end of non-threaded rod 122 is then connected to a compression spring for exerting a compressive force.

Figure 7:
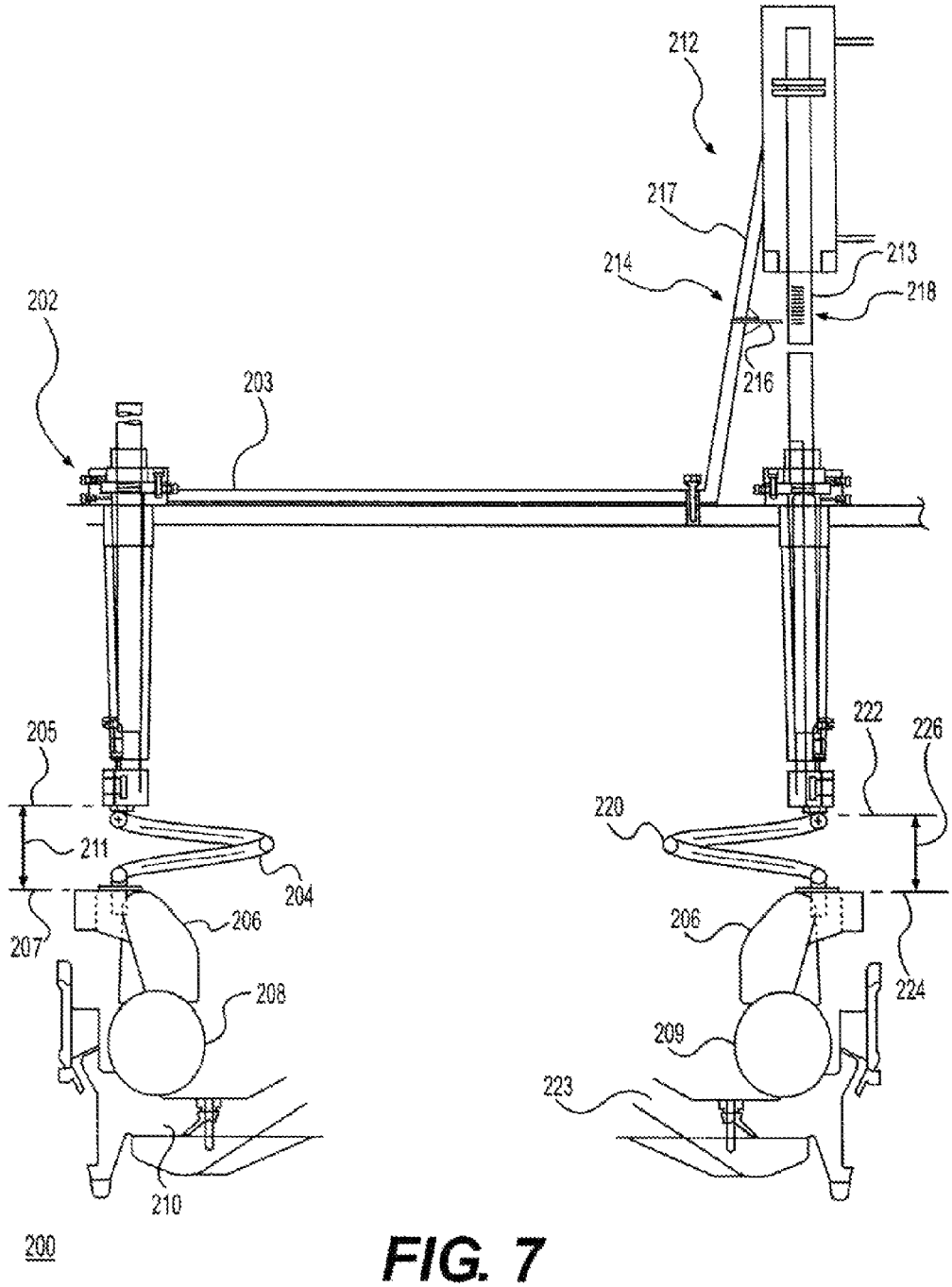
FIG. 7 is a tension adjustment gauge system for a ball and ring pulverizer configured in accordance with an embodiment constructed according to principles of the invention.

FIG. 7 is an illustration of a tension adjustment gauge mechanism for a ball and ring pulverizer configured in accordance with an embodiment of the invention, generally denoted by reference numeral 200. A manually adjusted spring loading system 202 is illustrated on the upper portion 203 of a pulverizer housing, similar to the individual threaded rods 110 and captive nuts 112 in the spring load assemblies 104 used to adjust compression spring 106 shown in FIG. 5. The manually adjusted spring loading system 202 includes a compression spring 204 for applying a proper load to an upper grinding ring 206 on a grinding ball 208, which rests upon a bottom grinding ring 210, thereby applying an operative pressure on the grinding balls. A spring gap 211 exists between the top portion 205 and bottom portion 207 of the of the compression spring 204.

In accordance with principles of the invention, a single hydraulic assembly 212 having a piston 213 with corresponding cylinder to encapsulate/or retain hydraulic fluid and the piston 213, and gauge 214 may be mounted to the upper portion 203 of the pulverizer housing. The gauge 214 may include a pointer 216 and linear scale 218 for determining horizontal movement of the piston 213 of the single hydraulic assembly 212. The linear scale 218 may be in any scale, for example, inches or centimeters.

FIG. 7 is a tension adjustment gauge system for a ball and ring pulverizer configured in accordance with an embodiment constructed according to principles of the invention. FIG. 7 also illustrates an embodiment of a hydraulic assembly wherein the pointer 216 may be mounted to a support means 217 securing the single hydraulic assembly 212 to the top portion 203 of the pulverizer housing. The single hydraulic assembly 212 may be connected to a single compression spring 220 having a top portion 222 and a bottom portion 224. A spring gap 226 corresponds to the distance between the top portion 222 and the bottom portion 224 of the single compression spring 220. The bottom portion 224 of the compression spring 220 may be secured to the upper grinding ring 206 on another grinding ball 209, which may rest upon a bottom grinding ring 210. Any increase or decrease in the spring gap 226 can be detected by a change in location of the pointer 216 on the linear scale 218. The change in the spring gap may be related to the wear of the compression spring 220, the grinding ball 209, grinding rings 206 and 209, or any combination thereof.

Figure 8A:
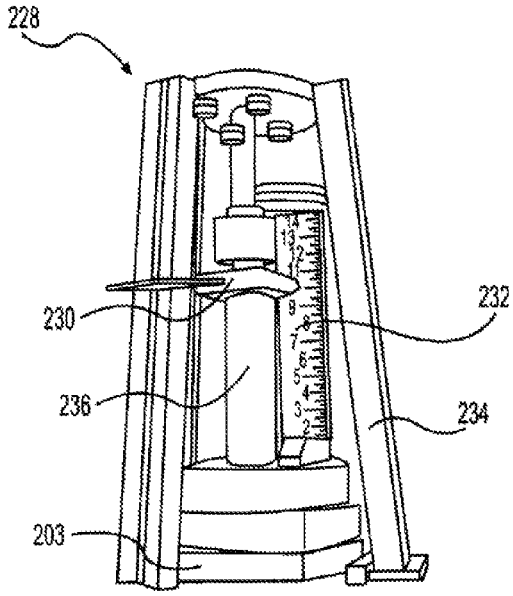
FIG. 8A illustrates another embodiment of a tension adjustment gauge mechanism, constructed according to principles of the invention.
Figure 8B:
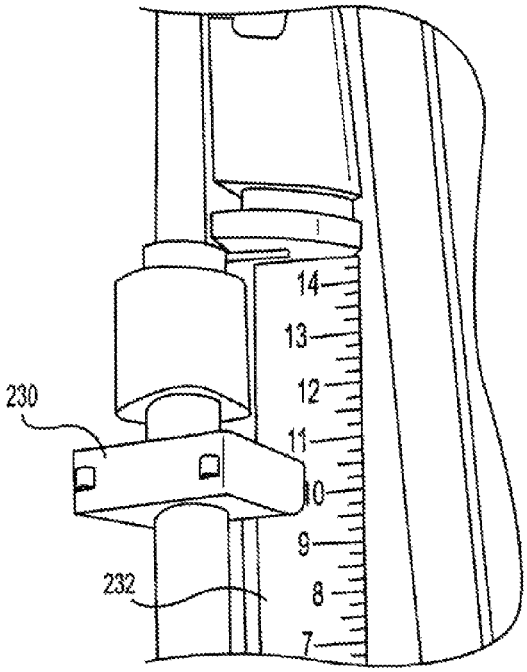
FIG. 8B provides a more detailed view of the pointer and the linear scale of FIG. 8A.

FIG. 8A illustrates another embodiment of a tension adjustment gauge mechanism, constructed according to principles of the invention, denoted generally as reference numeral 228. A pointer 230 may be mounted on the piston 236 (or shaft) of the single hydraulic assembly and the linear scale 232 may be mounted to a rigid support 234. FIG. 8B provides a more detailed view of the pointer 230 and the linear scale 232 of FIG. 8A. As can be scene in FIG. 8B, the linear scale 234 is in inches, but may be calibrated in any other practical measuring unit.

Figure 9:
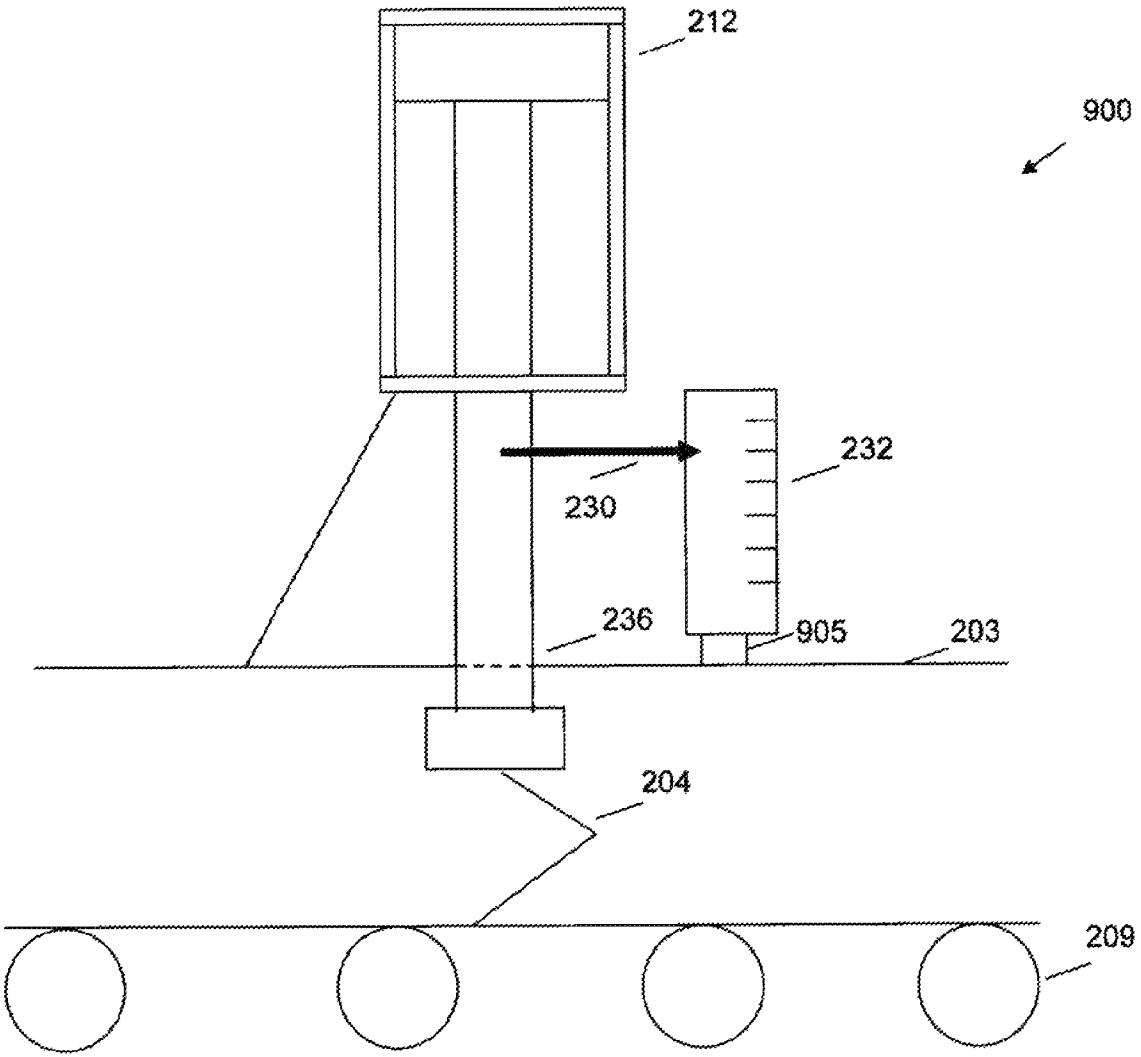
FIG. 9 illustrates a simplified embodiment of the single hydraulic assembly and gauge system, configured according to principles of the invention.

FIG. 9 illustrates a simplified embodiment of a single hydraulic assembly and gauge system, constructed according to principles of the present invention, generally denoted by reference numeral 900. This embodiment is similar to the embodiments of FIGS. 8A and 8B, except the linear scale 232 is shown mounted to a support 905. The pointer 230 affixed to piston 236 may move as spring 204 changes, thereby causing piston 236 to vary with the variation being readable on linear scale 232. The scale may be in nearly any useful units such as inches, millimeters, or the like.

In accordance with a method of the invention, a "system operating pressure" may be established by adjusting hydraulic pressure until the gauge's corresponding spring is properly tensioned. At that point, a reference reading may be taken from the gauge's built in "scale and pointer." This reference reading may be used to calculate the next set of tension adjustments. Pulverizers may then be run for a predetermined amount of time. Once the determination is made that an adjustment is necessary, the following procedure may be followed. During a tension adjustment process, the coal flow to the mill is interrupted and the mill is temporarily turned off. Valves on both the high and low press side of the gauge's cylinder are opened until system pressure decays to 0 psi. The cylinder valves are then closed and the hydraulic pump is turned on. Once the previously determined "system pressure" is reestablished a reading is taken from the scale/pointer. This reading is subtracted from the previous reading to determine the amount of adjustment required for the remaining springs. The mill is then restarted and the remaining springs are adjusted manually using conventional methods.

Figure 10A:
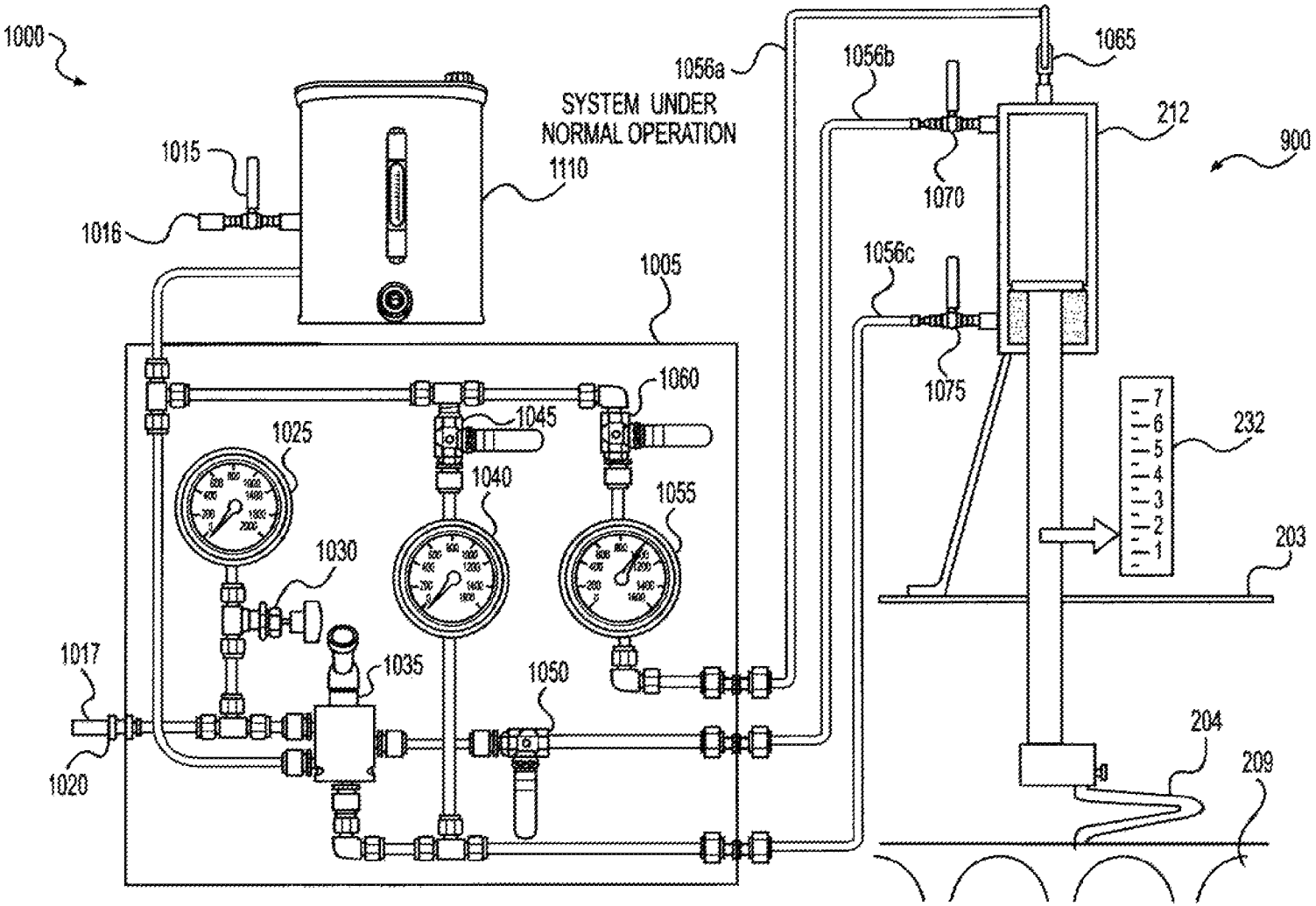
FIGS. 10A-10U are exemplary functional block diagrams of an embodiment of a tension and adjustment gauge system, constructed according to principles of the invention.
Figure 10B:
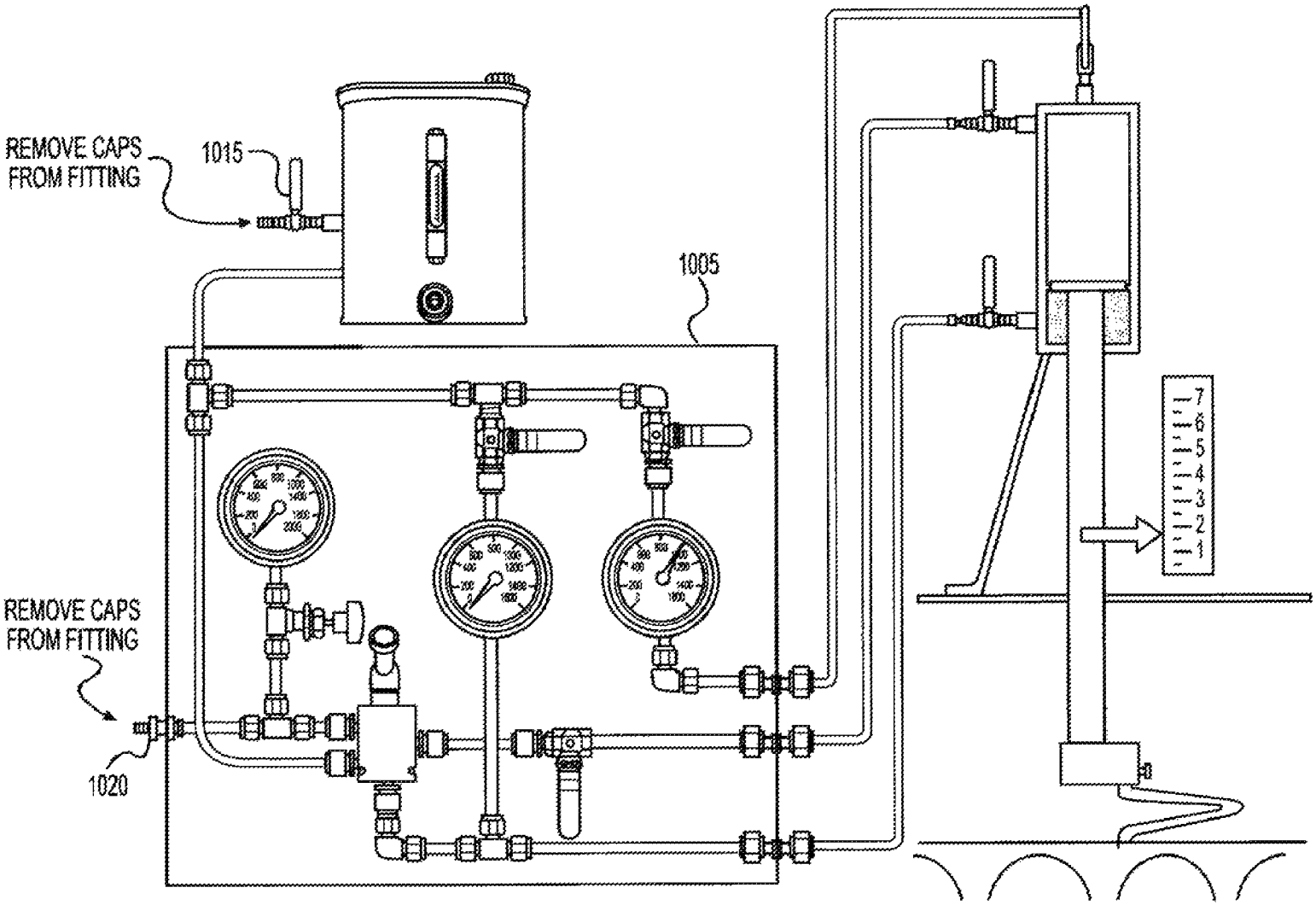
Figure 10C:
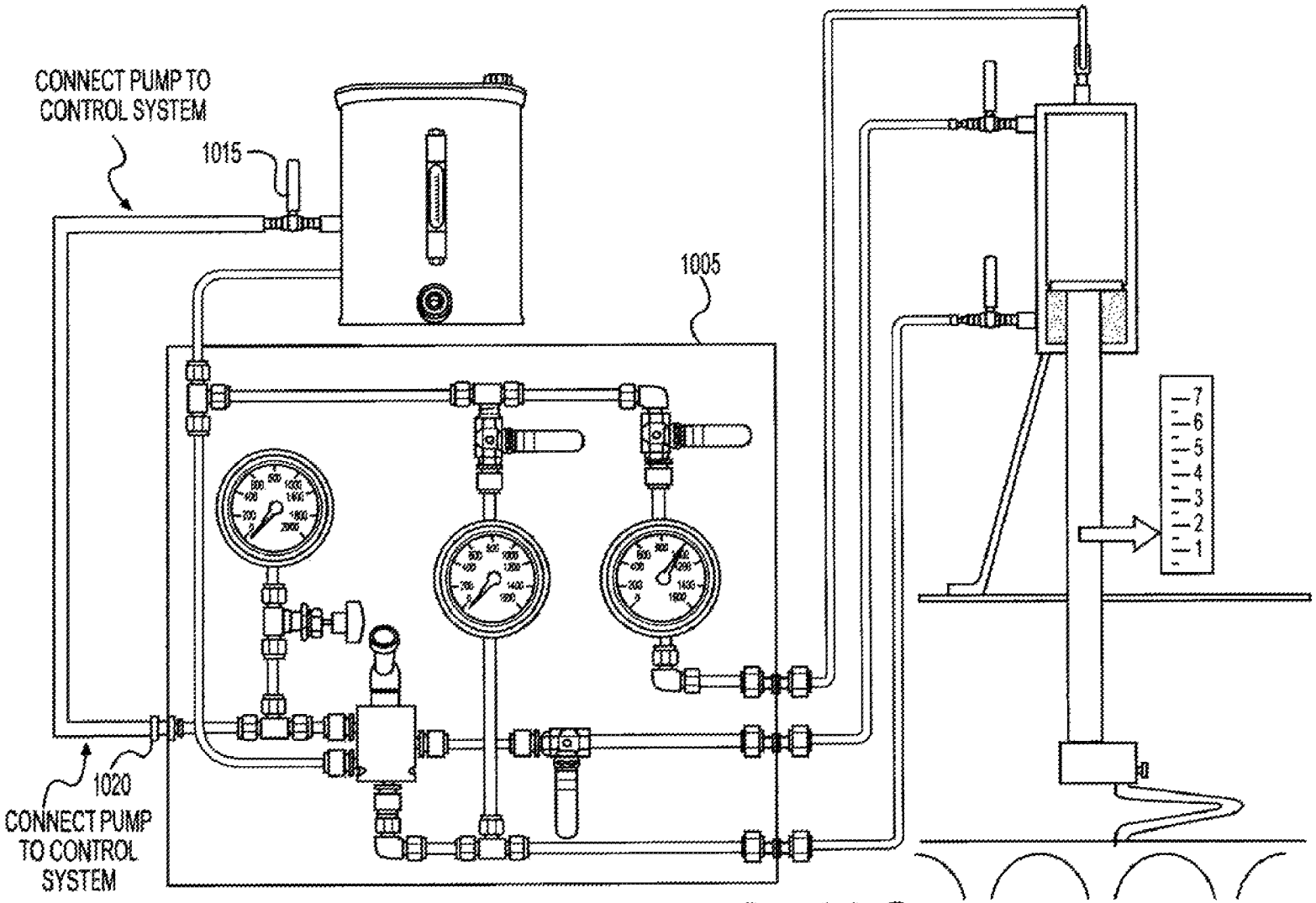
Figure 10D:
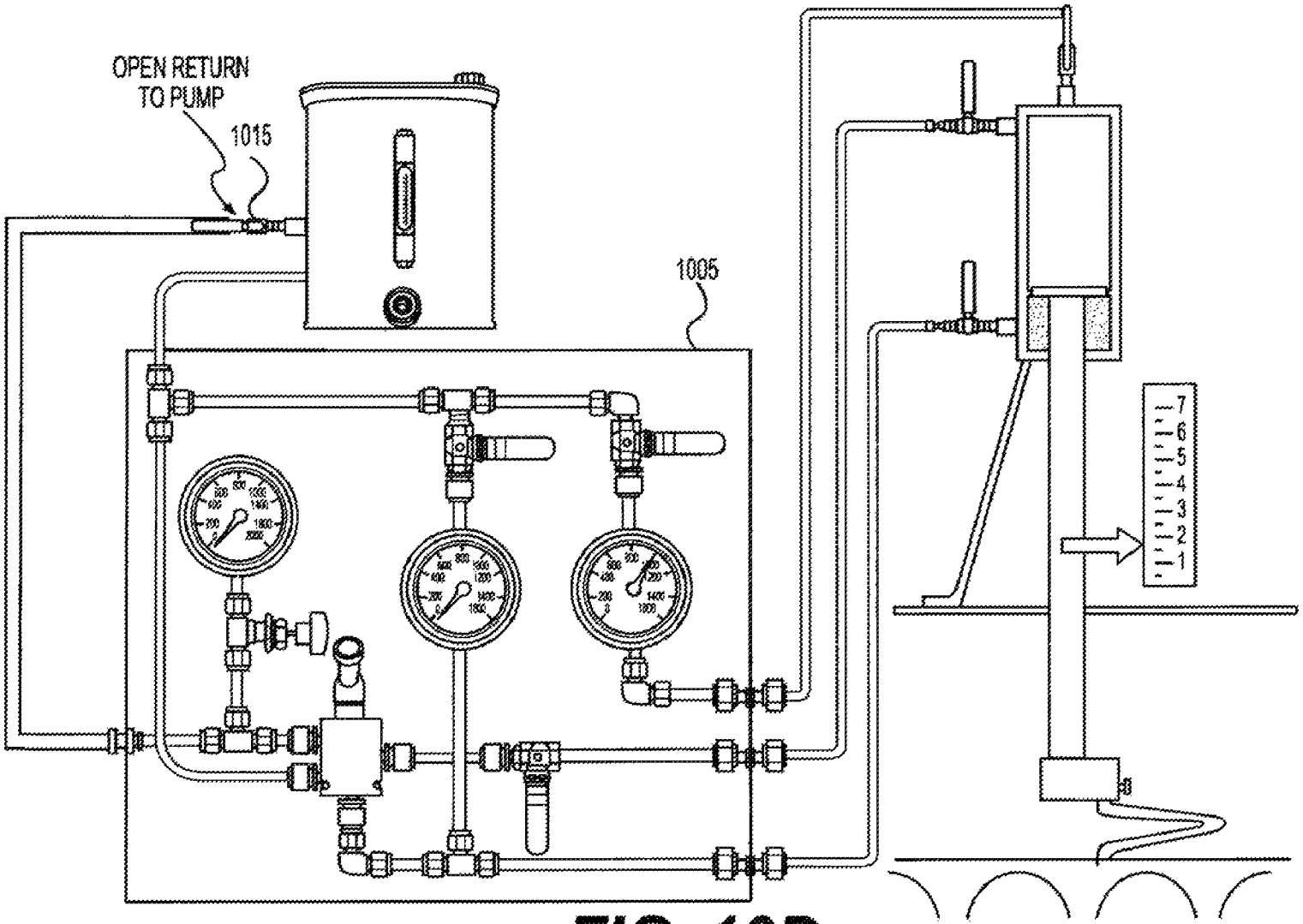
Figure 10E:
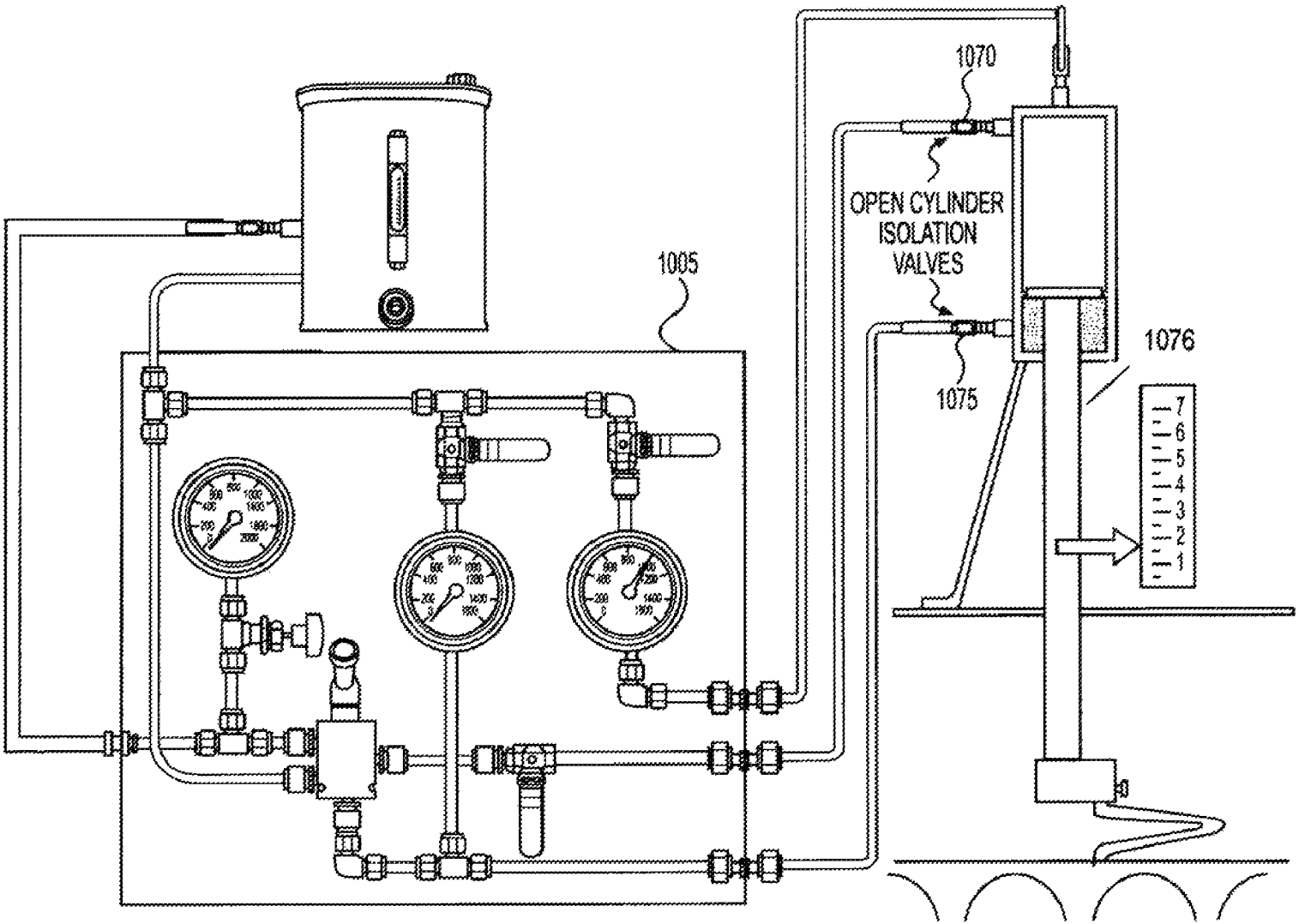
Figure 10F:
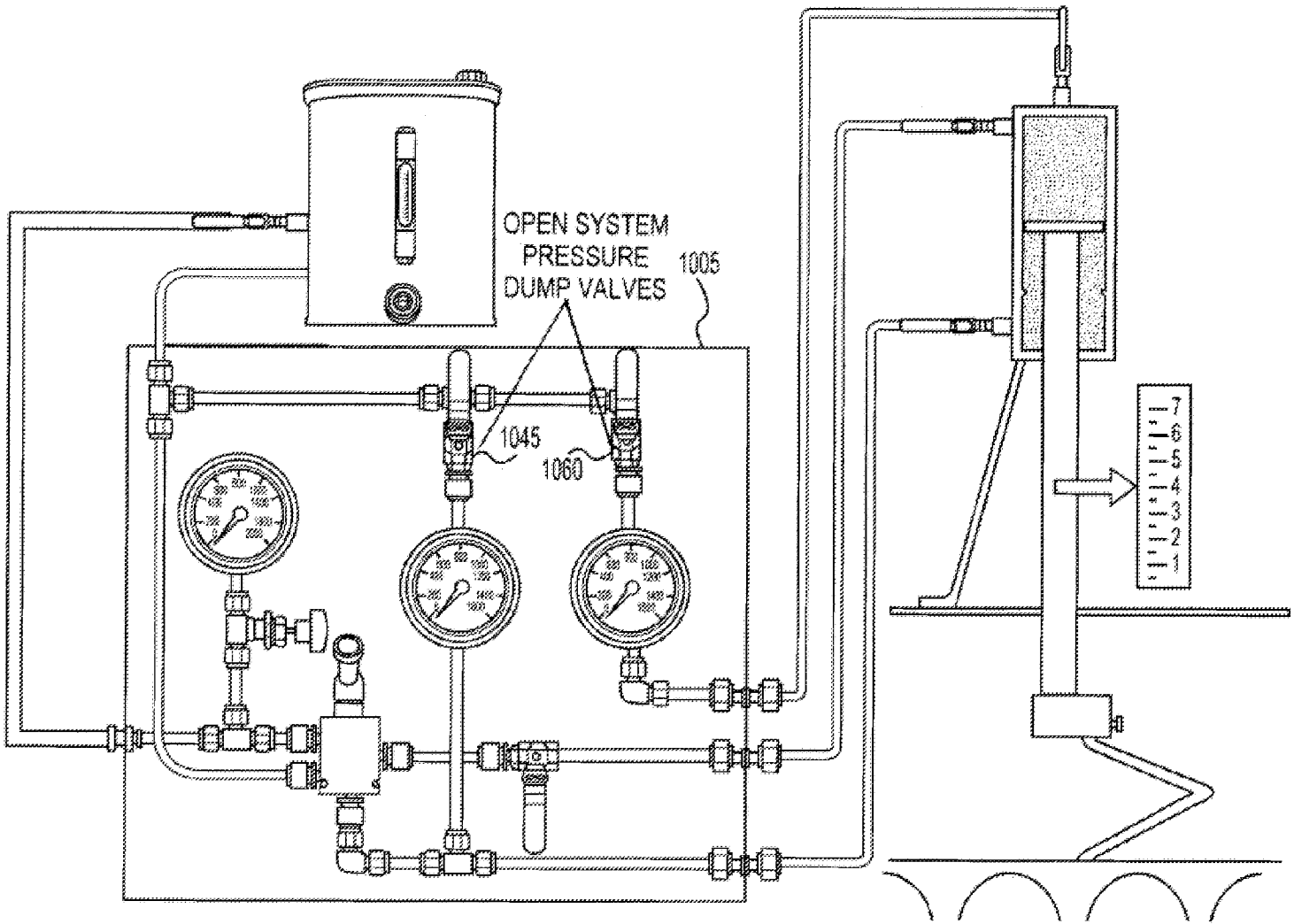
Figure 10G:
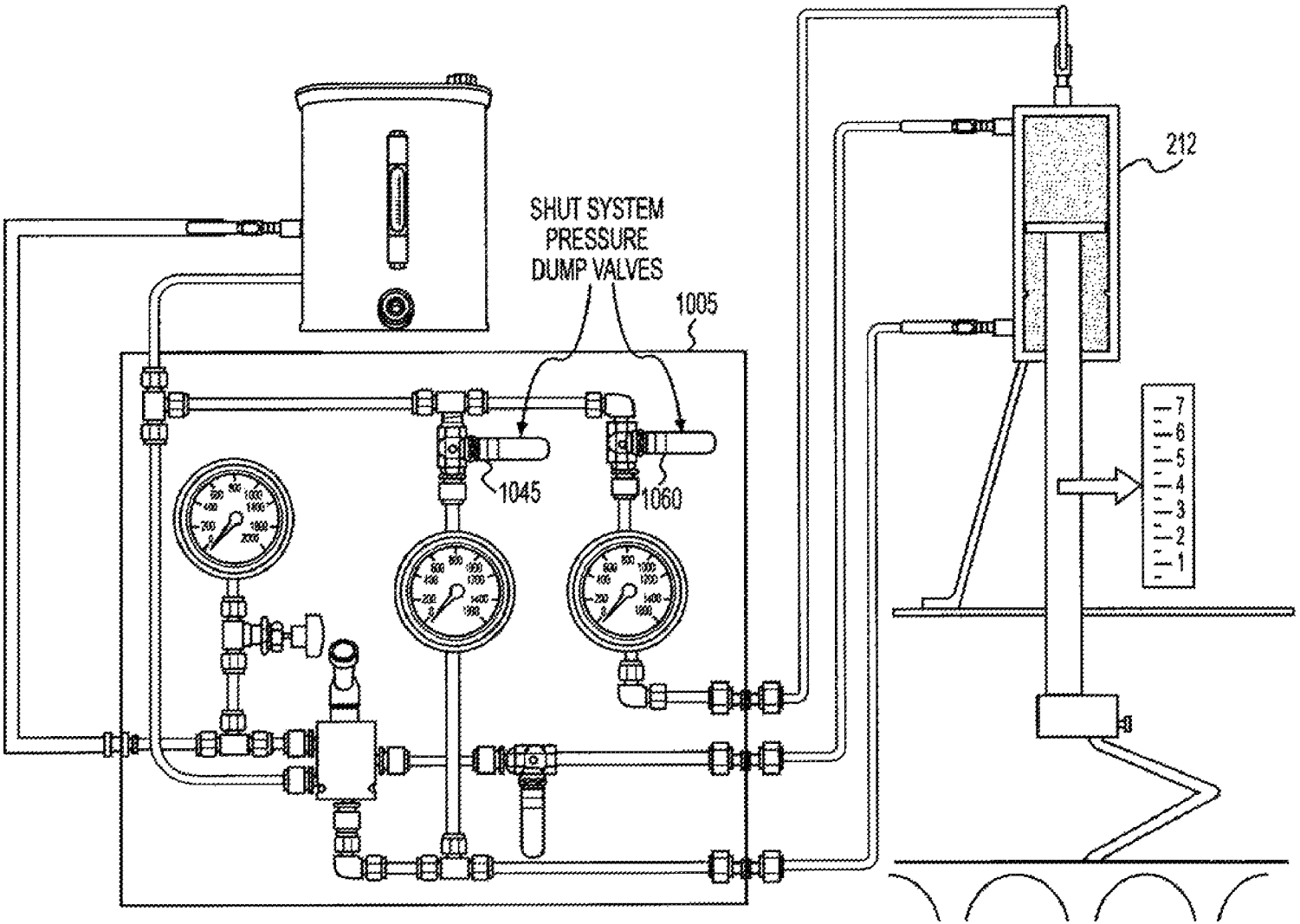
Figure 10H:
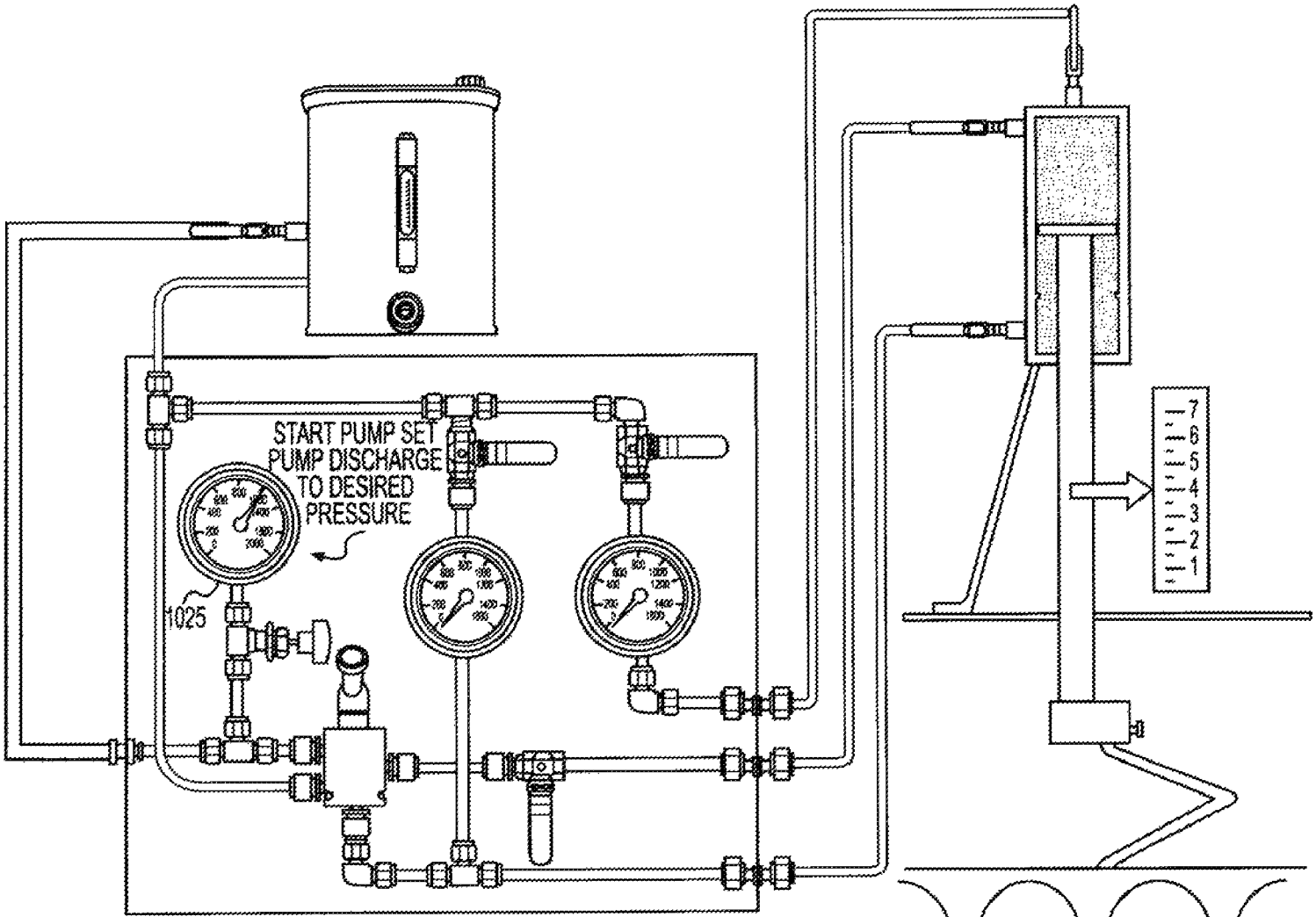
Figure 10I:
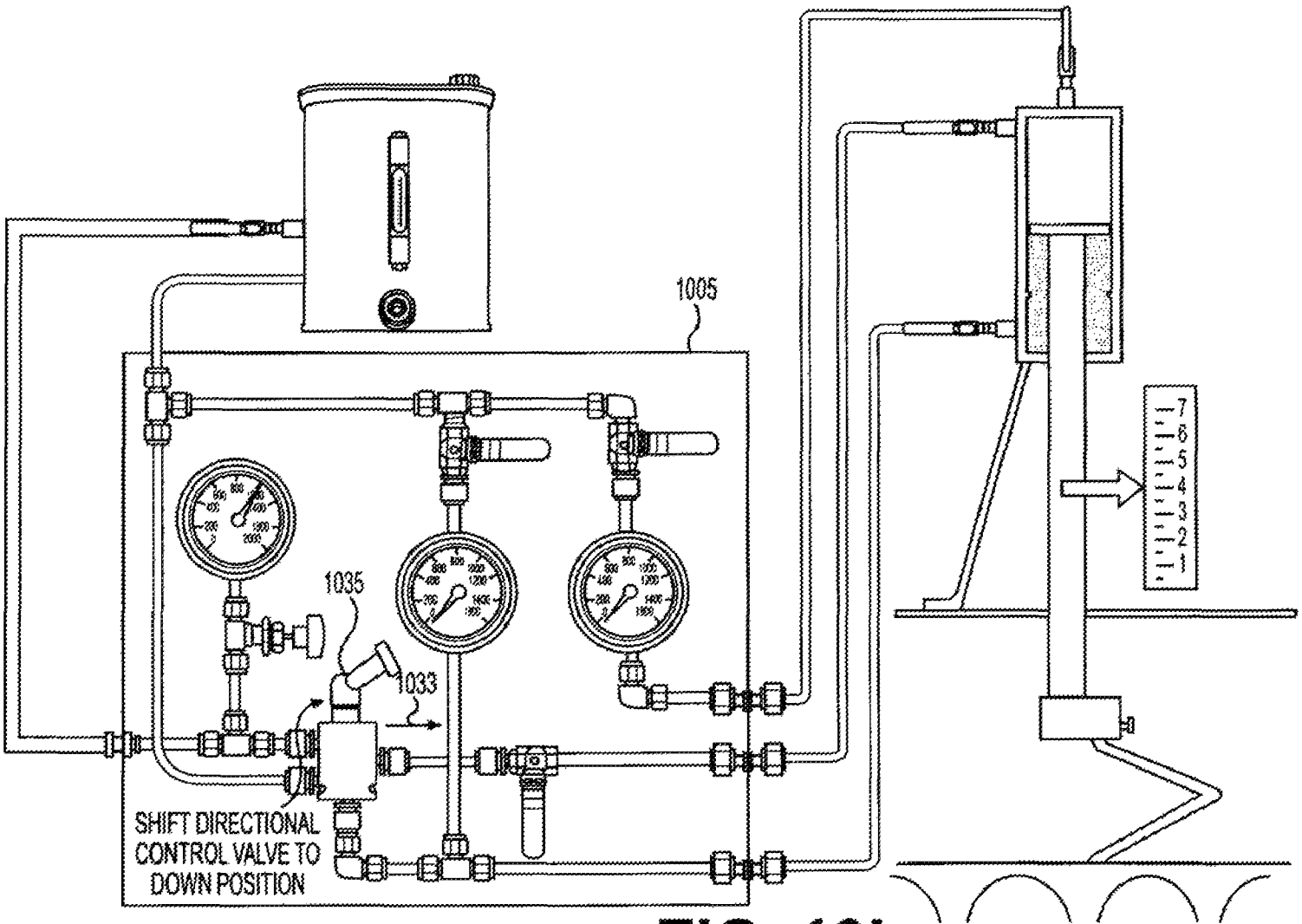
Figure 10J:
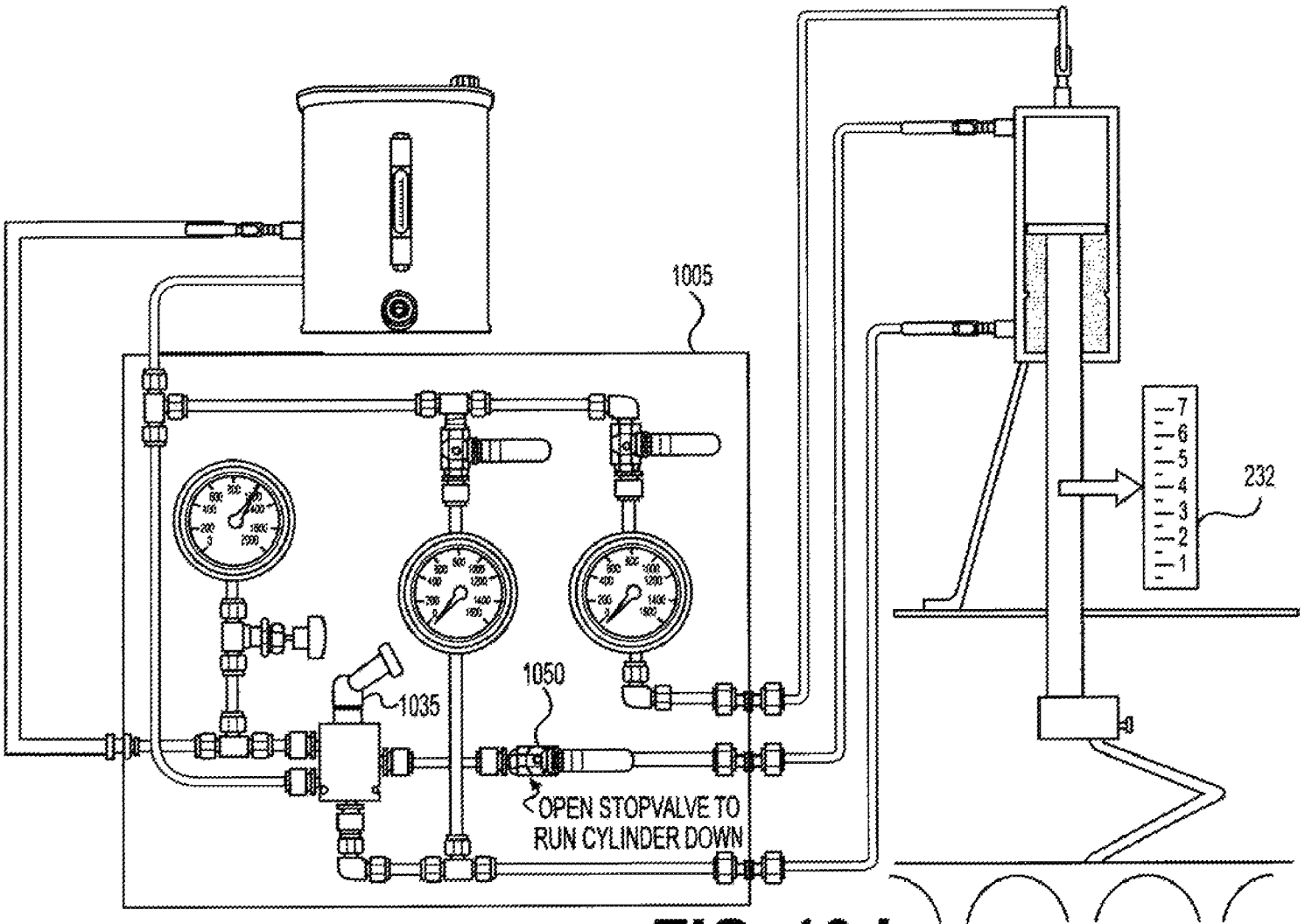
Figure 10K:
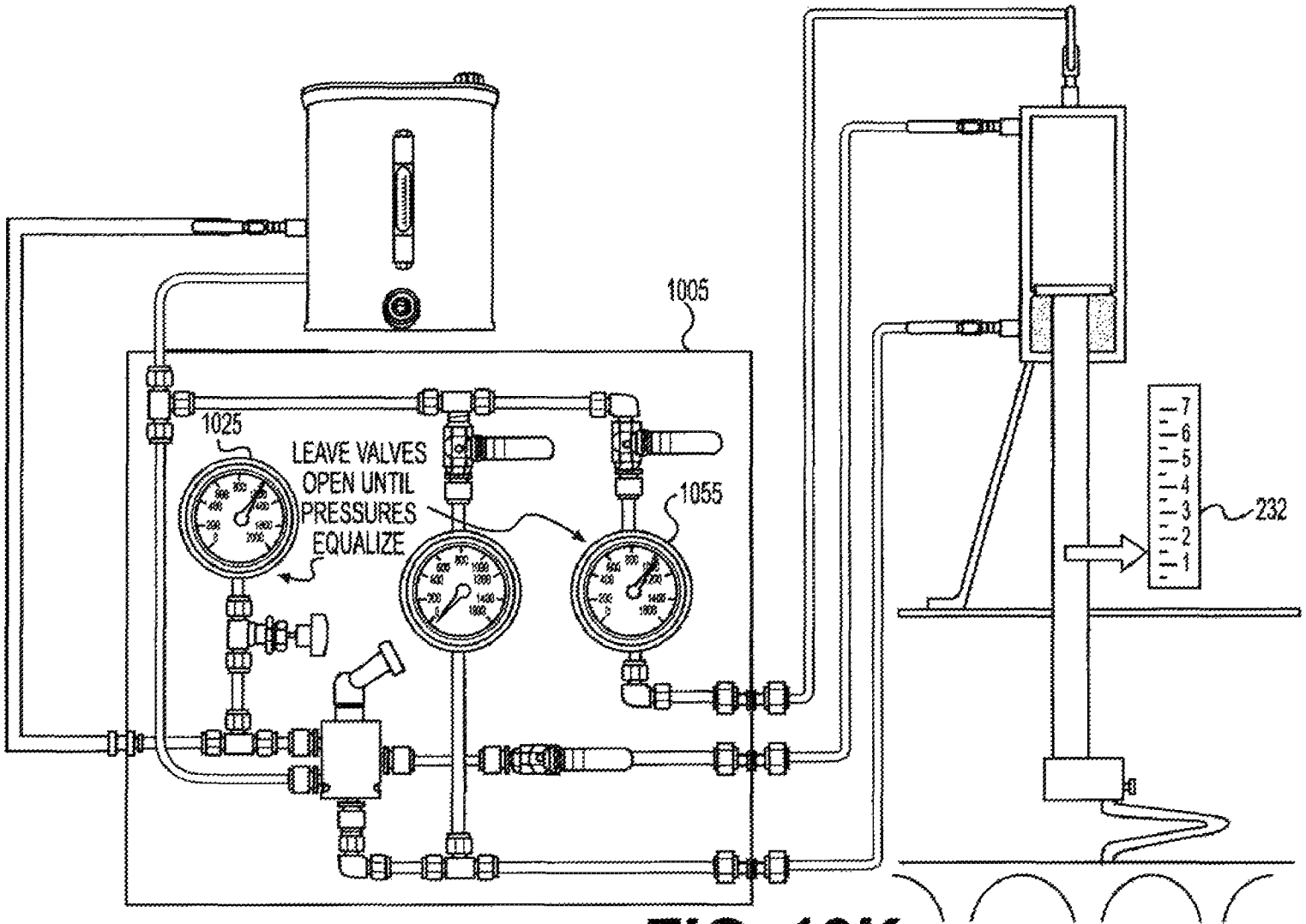
Figure 10L:
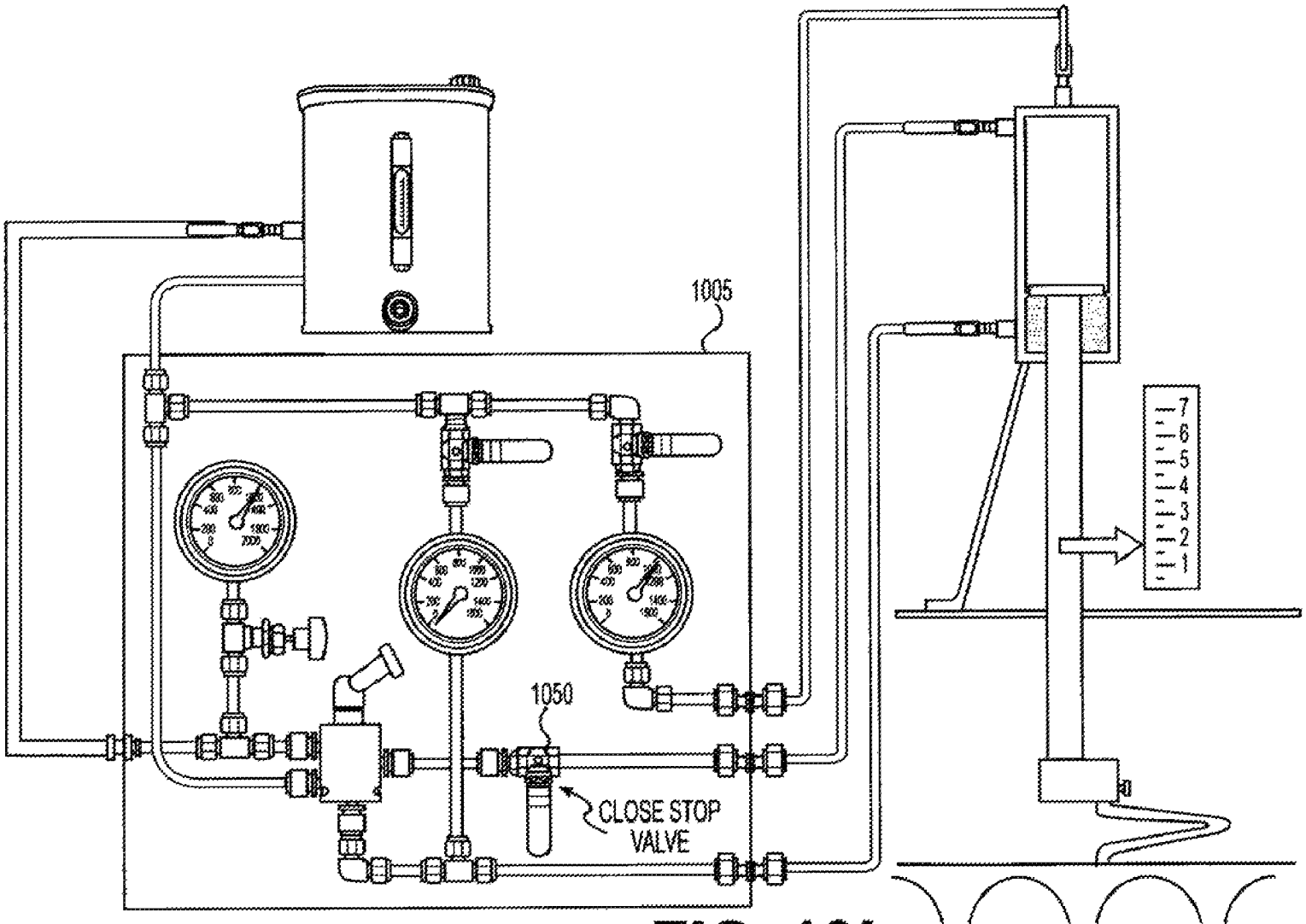
Figure 10M:
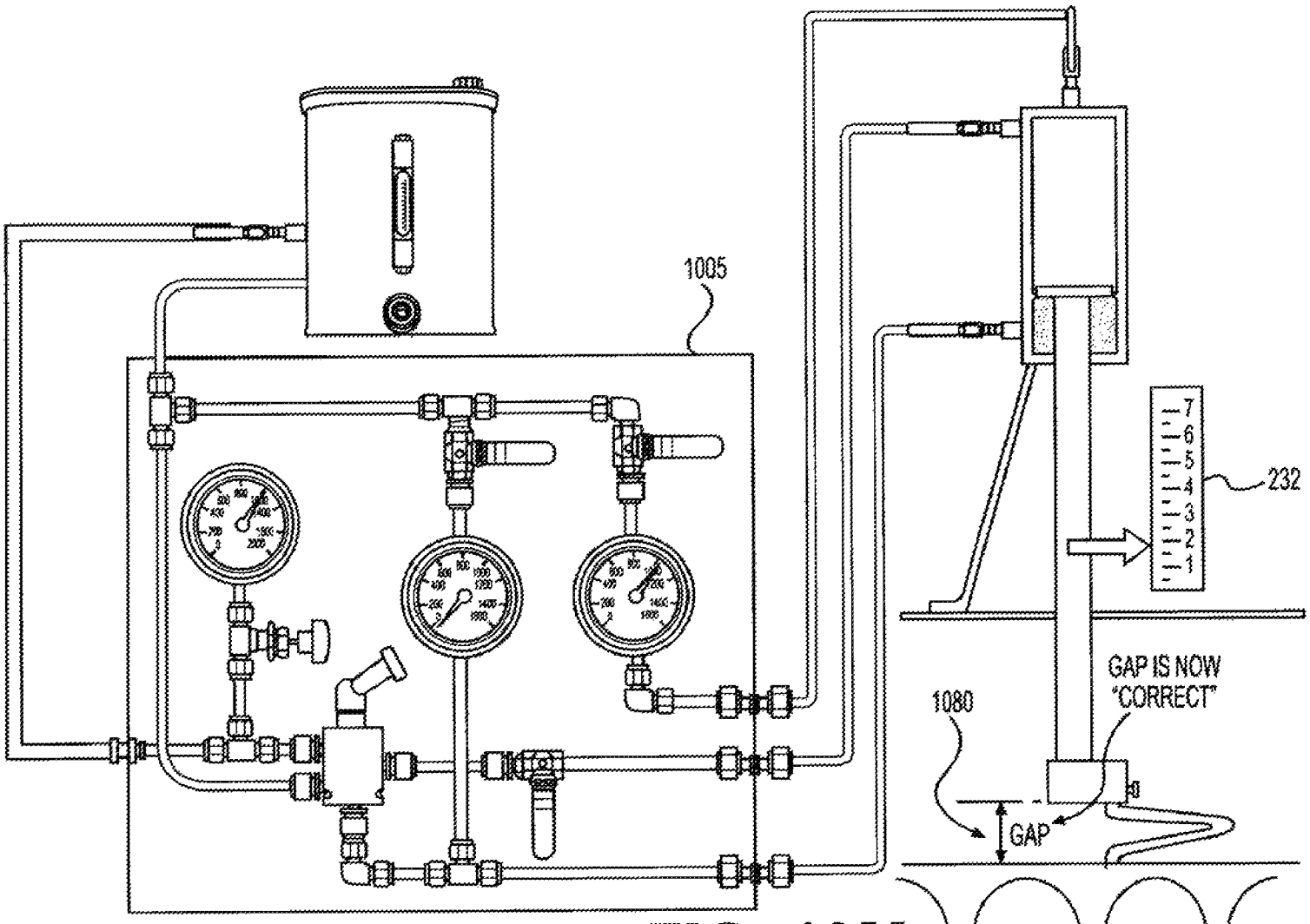
Figure 10N:
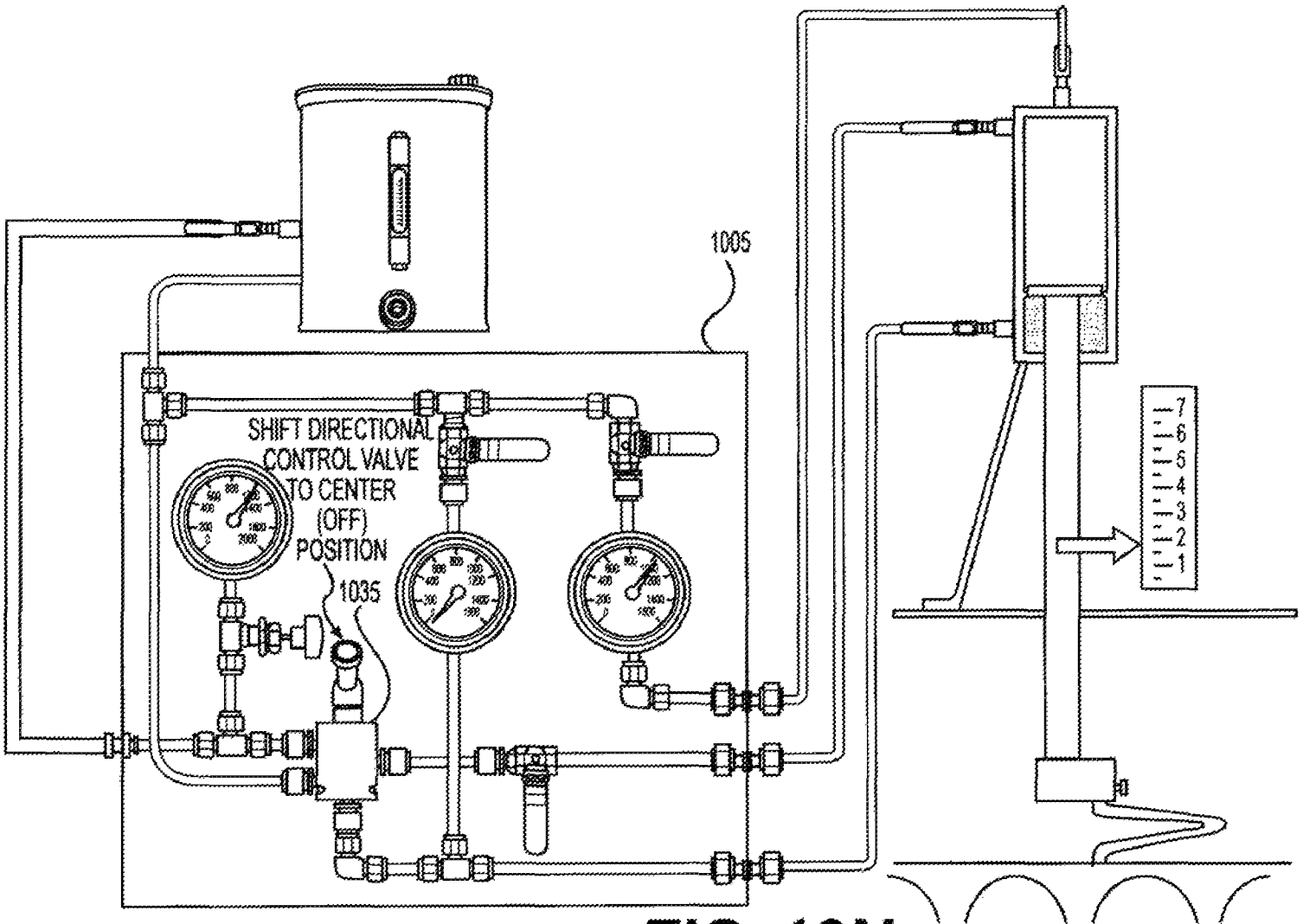
Figure 10O:
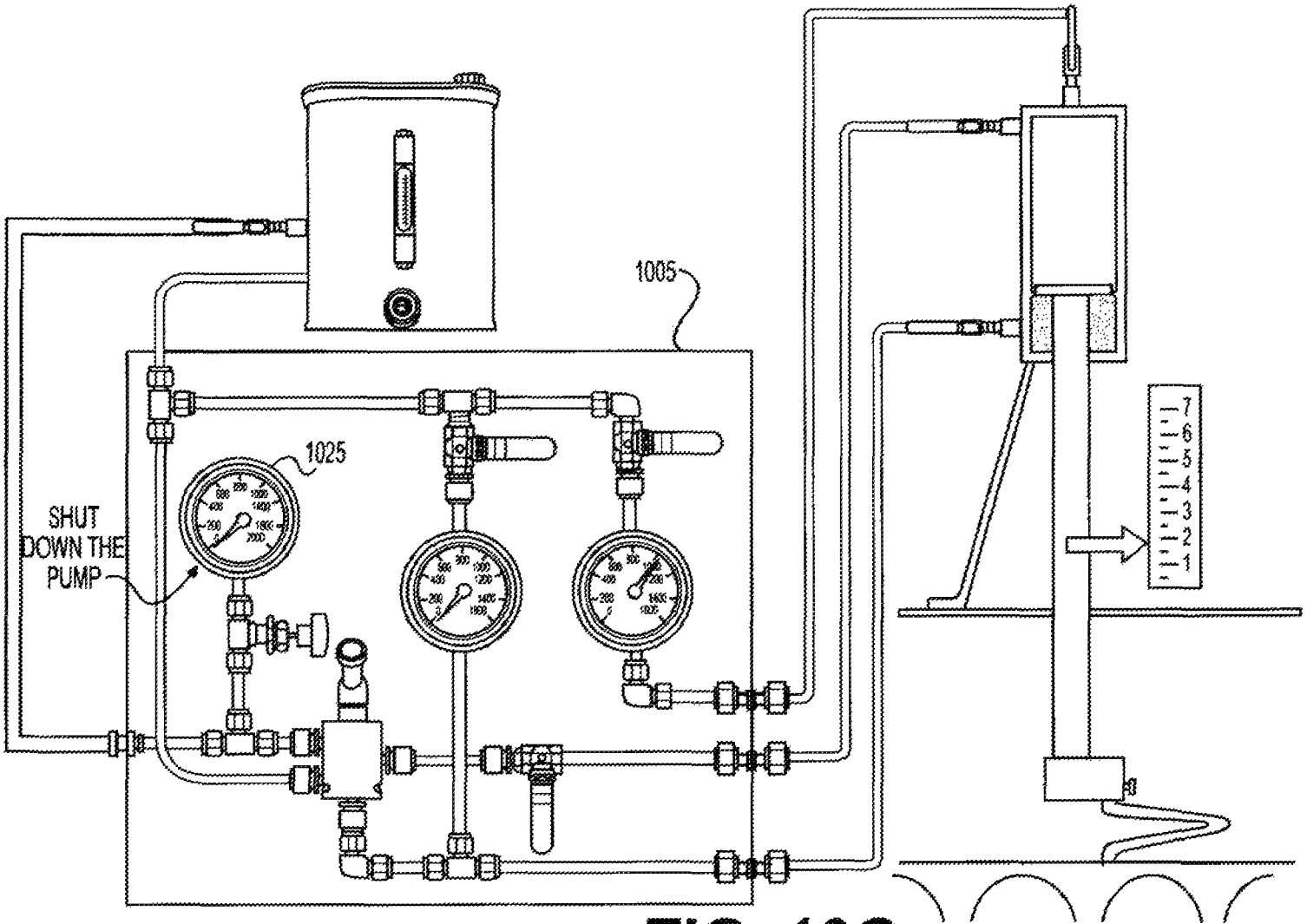
Figure 10P:
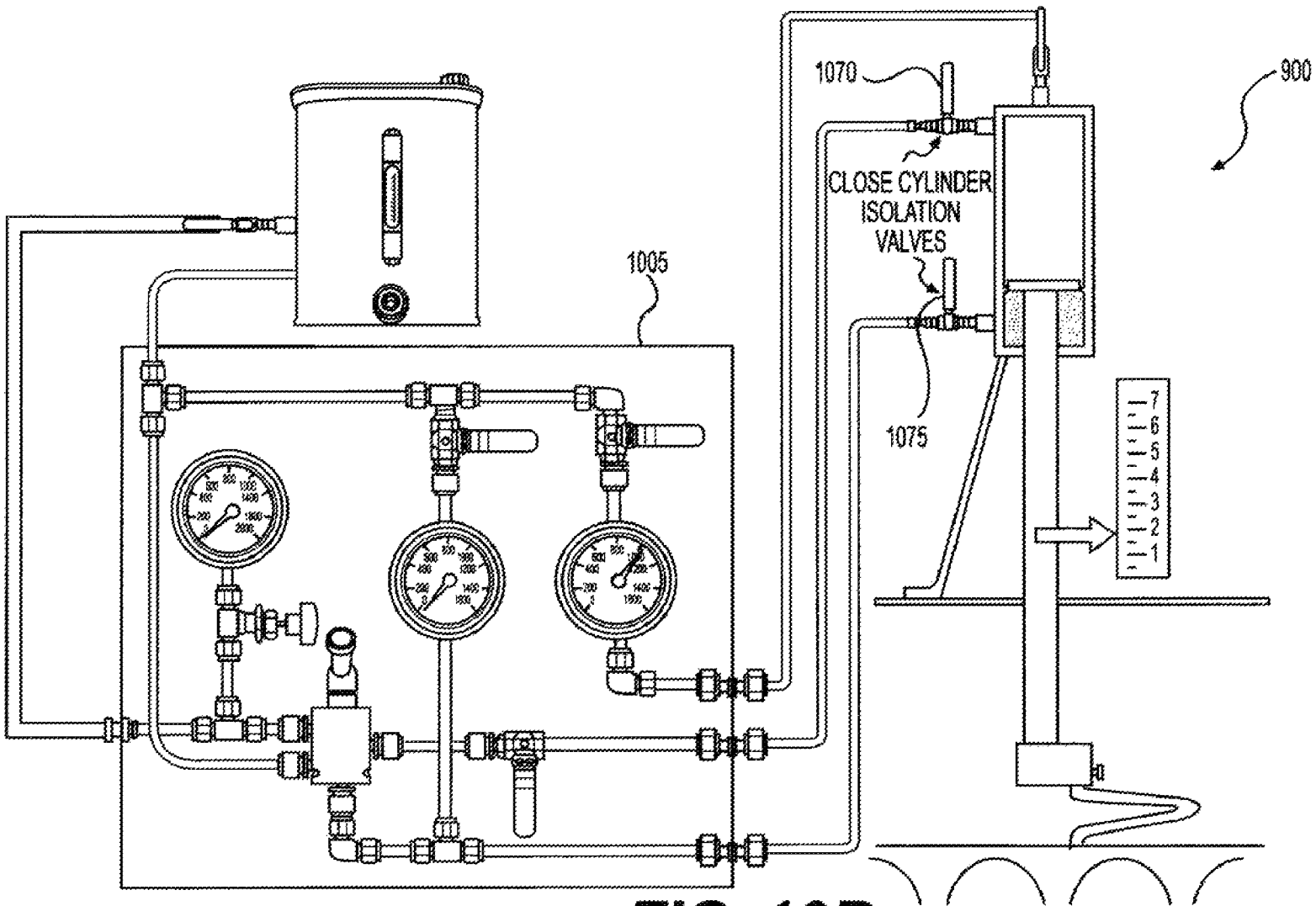
Figure 10Q:
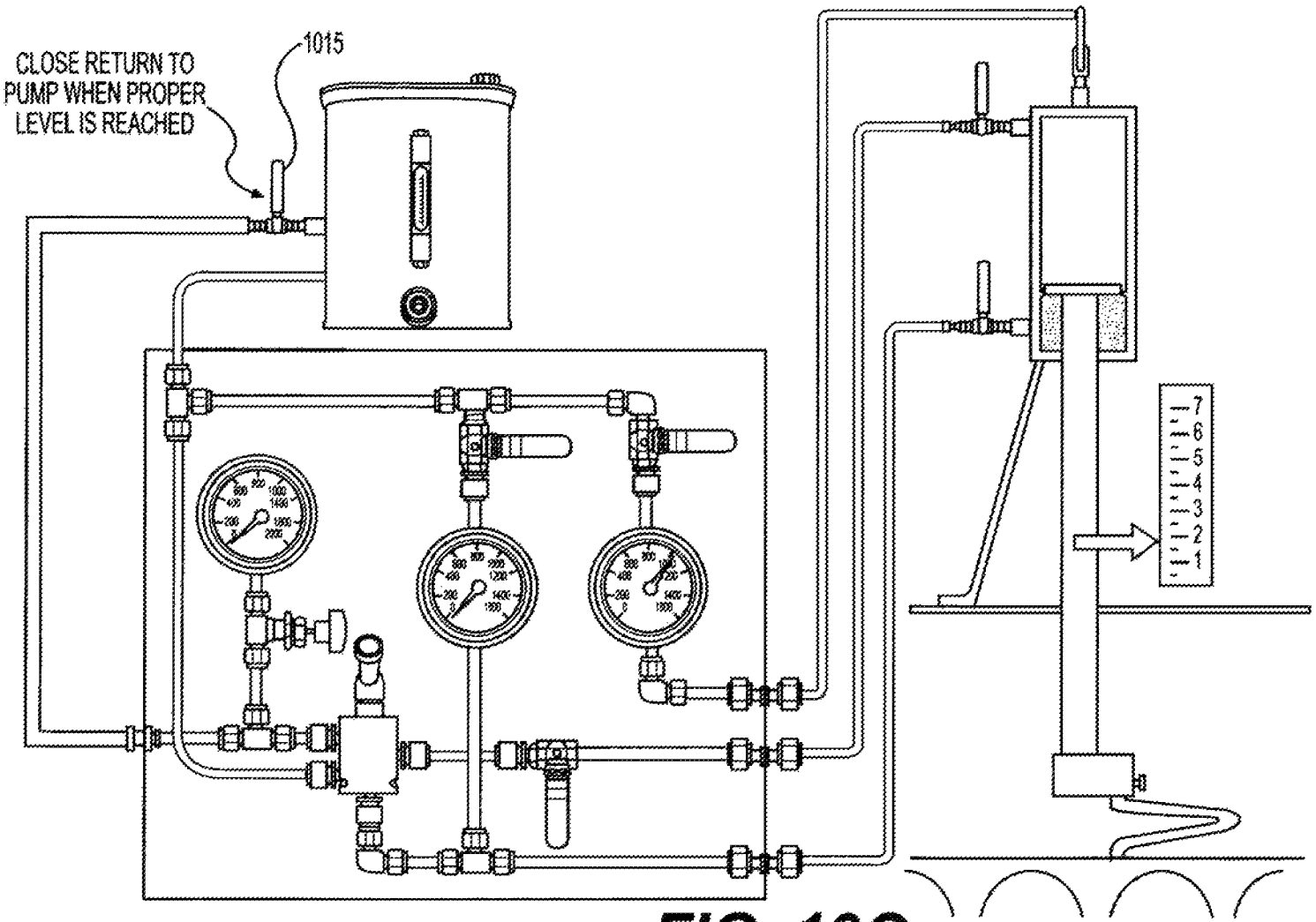
Figure 10R:
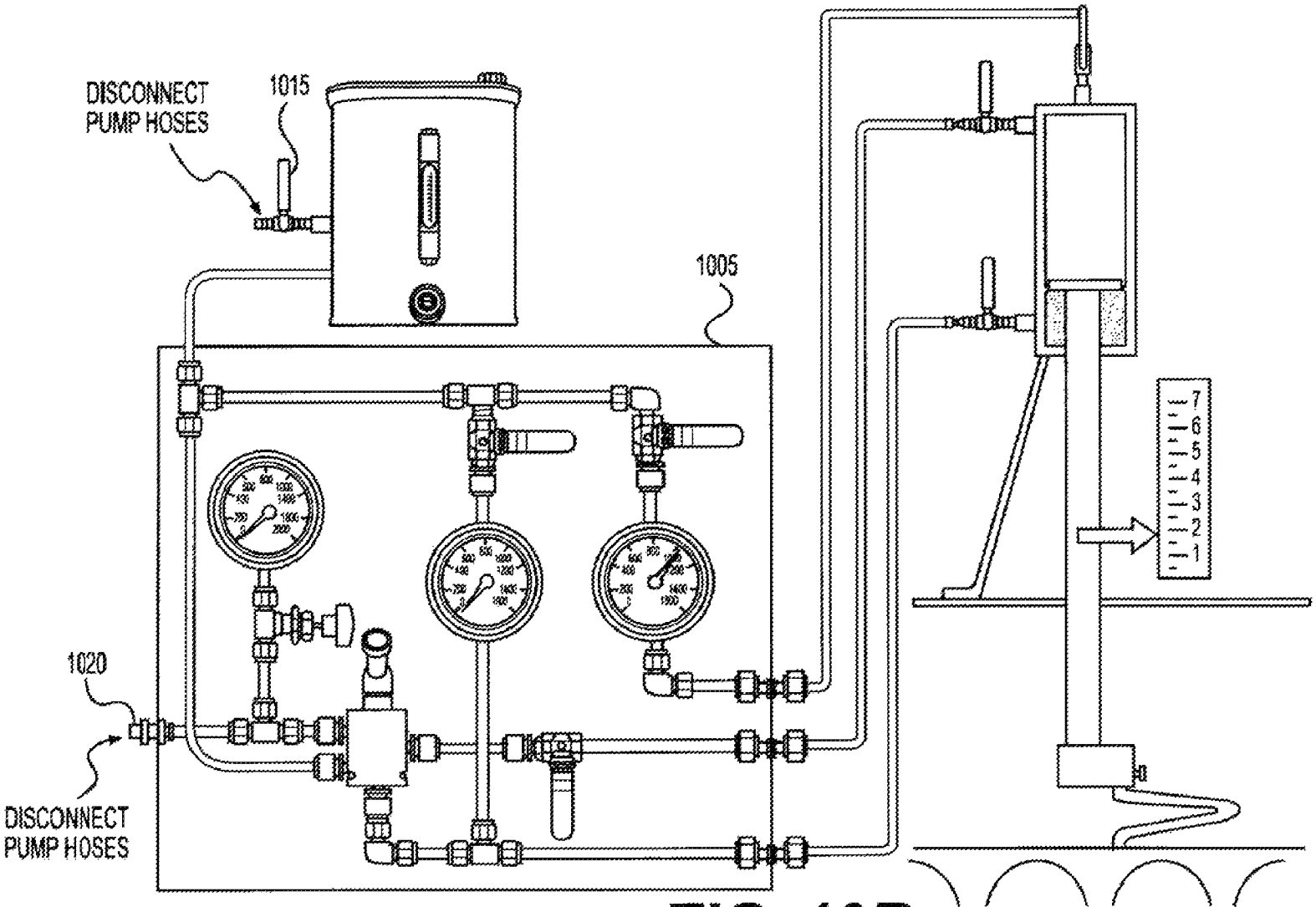
Figure 10S:
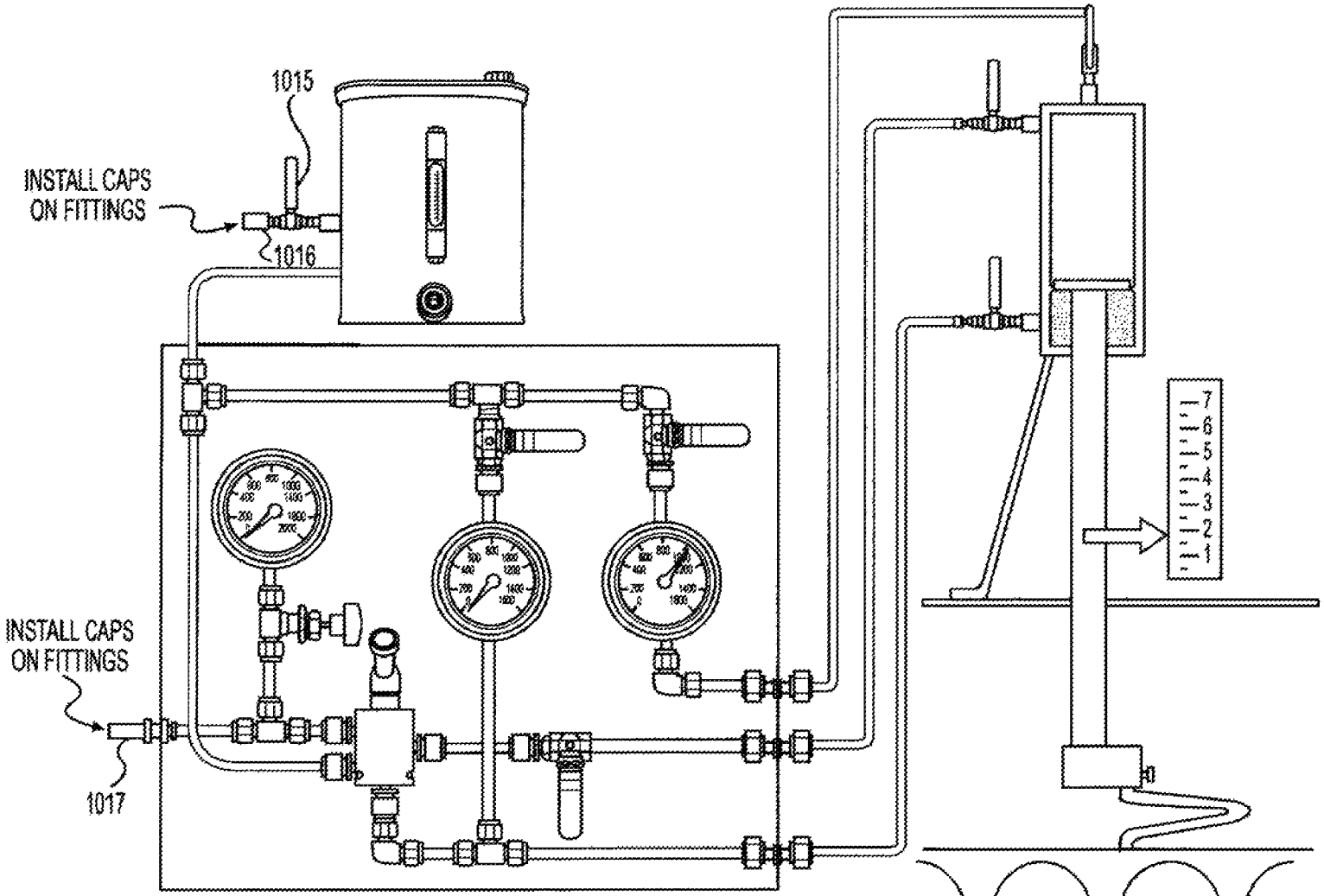
Figure 10T:
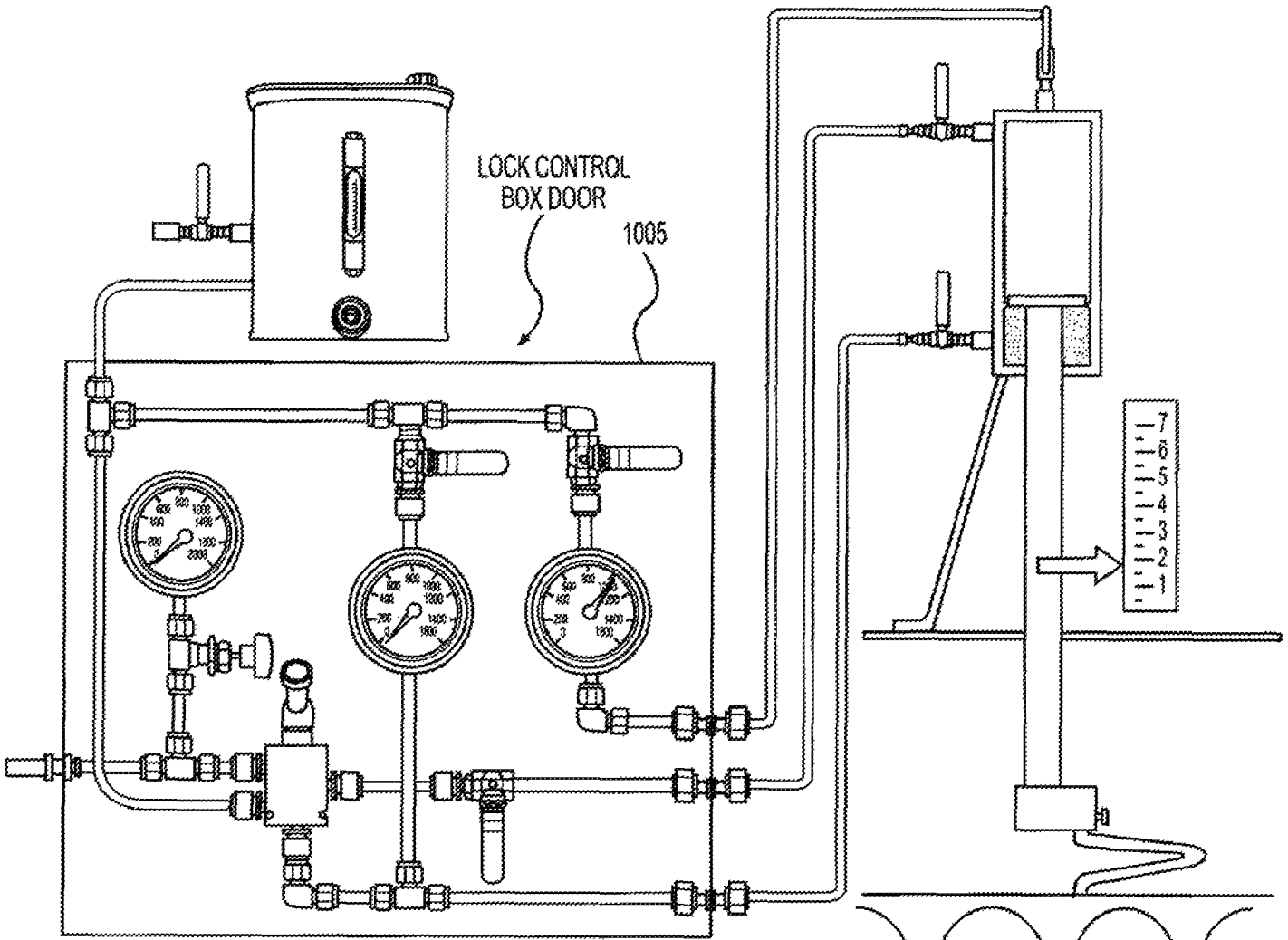
Figure 10U:
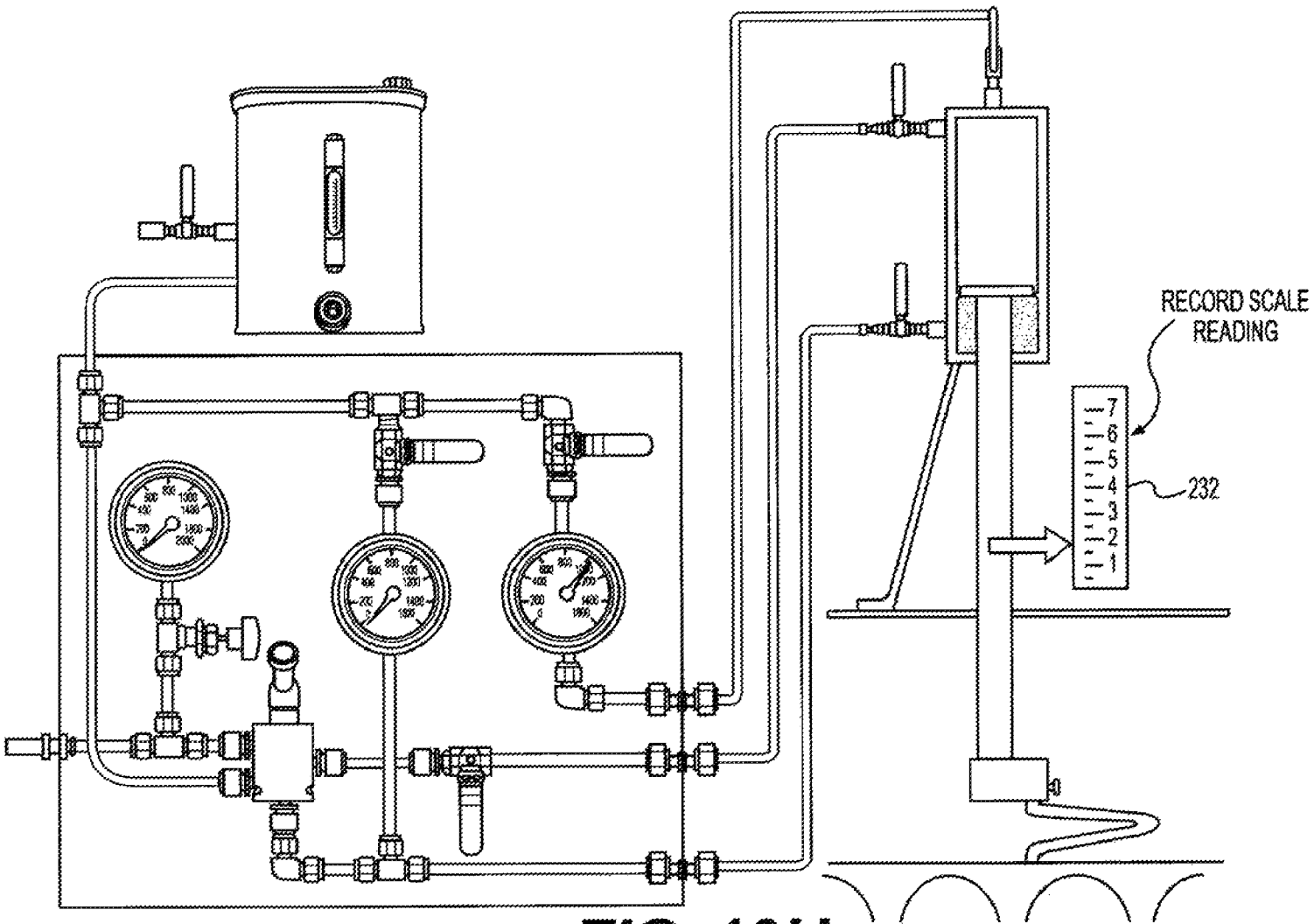

FIGS. 10A-10U are exemplary functional block diagrams of an embodiment of a tension and adjustment gauge system, constructed according to principles of the invention, denoted generally by reference numeral 1000. FIGS. 10A-10U may also be interpreted as a process showing exemplary steps of utilizing the tension and adjustment gauge system thereof. FIG. 10A may reflect a "normal" state of operations while an associated pulverizer is in operation. The tension and adjustment gauge system 1000 includes at least one control box 1005 having valves (1030, 1035, 1045, 1050 and 1060, shown closed) and gauges (1025, 1040 and 1055), all described more fully below, to control hydraulic operations on the at least one hydraulic assembly 212, such as for re-tensioning the spring 204. Gauge 1055 shows a "current" operational pressure at the hydraulic assembly 212. Hydraulic assembly 212 is exemplary, and is not meant to be limited to only this embodiment of the hydraulic assembly. A coal pulverizing mill may have multiple tension and adjustment gauge systems as shown in FIG. 10A, depending on the number of pulverizes employed at the mill. A head tank 1110 may be present and interconnected as shown, which may be partially filled with oil to keep air from entering the hydraulic system while being operated. Without the head tank 1110 the system might pull air in through the seals or any open ended lines.

Pressure discharge control gauge 1025 may be a pump discharge gauge, the pressure reflected by the gauge 1025 may be controlled by valves 1030 and 1035, and may display pressure applied to or present at the cylinder of the single hydraulic assembly 212, described more fully below. The gauge 1025 may be interconnected by way of pressure line 1056*b* to the single hydraulic assembly 212 via valve 1070. An isolation valve 1050 may also be present and discussed more fully below. Pressure gauge 1040 may be interconnected by pressure line 1056*c* to the bottom of single hydraulic assembly 212 via valve 1075. Pressure gauge 1055 may be interconnected by pressure line 1056*a* to the top of the single hydraulic assembly 212 via valve 1065. Moreover, system pressure dump valves 1045, 1060 may be present as shown for releasing or controlling pressure at various stages of the process, described more fully below.

FIG. 10B shows the interconnection of a hydraulic fluid pump (not shown) to the control system at or proximate valves 1015 and 1020. Caps 1016 and 1017 may be removed. FIG. 10B may be a first step in as process of utilizing the tension and adjustment gauge system. The remaining FIGS. 10C-10U may be considered as additional steps in the overall process. At FIG. 10C, pressure lines may be connected to the control system at valves 1015 and 1020. At FIG. 10D, valve 1015 may be opened creating a return path to the pump (not shown).

In FIG. 10E, cylinder isolation valves 1070, 1075 may be opened. In FIG. 10F, dump valves 1045, 1060 may be opened to release pressure in the hydraulic assembly. Note that the level of the piston 1076 may decrease with a corresponding change in the linear scale 232 and spring 204 compression. Once the pressure normalizes, in FIG. 10F, dump valves 1045, 1060 may be closed, as FIG. 10G. In FIG. 10H, the hydraulic pump (not shown) for pressurizing hydraulic fluid may be started and the pump discharge may be set to a desired pressure, as shown in gauge 1025 which shows an exemplary pressure of just over 1000 psi.

In FIG. 10I, directional control valve 1035 may be set to prepare to pressurize the hydraulic assembly 212, in a direction as shown by arrow 1033. Generally, the directional control valve 1035 includes controlling the desired direction of movement of the hydraulic cylinder in hydraulic assembly 212, i.e., either up or down. In FIG. 10J, the stop valve 1050 may be opened to force the piston 1076 down, the spring 204 and linear scale 236 responding to the pressure applied. In FIG. 10K, the valves 1035 and 1050 may remain open (other valves remain in the same position) until the pressure equalizes at gauges 1025 and 1055. In FIG. 10L, the stop valve 1050 may be closed.

In FIG. 10M, the "gap" in the spring 204 should now be at a "correct" or "desired" compression. In FIG. 10N, the directional valve 1035 may be closed. At FIG. 10-O, the hydraulic pump (not shown) may be shut down, as shown by pressure gauge 1025 (zero pressure). In FIG. 10P, the cylinder isolation valves 1070 and 1075 may be closed. In FIG. 10Q, the return valve 1015 may be closed. Note: gauge 1055 should still read desired pressure, in this example, slightly over 1000 psi. In FIG. 10R, pump hoses may be disconnected at (or proximate) valves 1015 and 1020. In FIG. 10S, optionally, caps 1016, 1017 may be placed over fittings proximate valves 1015, 1017, to protect the fittings. In FIG. 10T, optionally, the control box 1005 may be covered or a door closed, perhaps locked, to secure the control box to prevent unauthorized access. In FIG. 10U, a recordation of the reading of the linear scale may be made, for future use and reference. The mill and/or pulverizer may be placed back in service.

Figure 11:
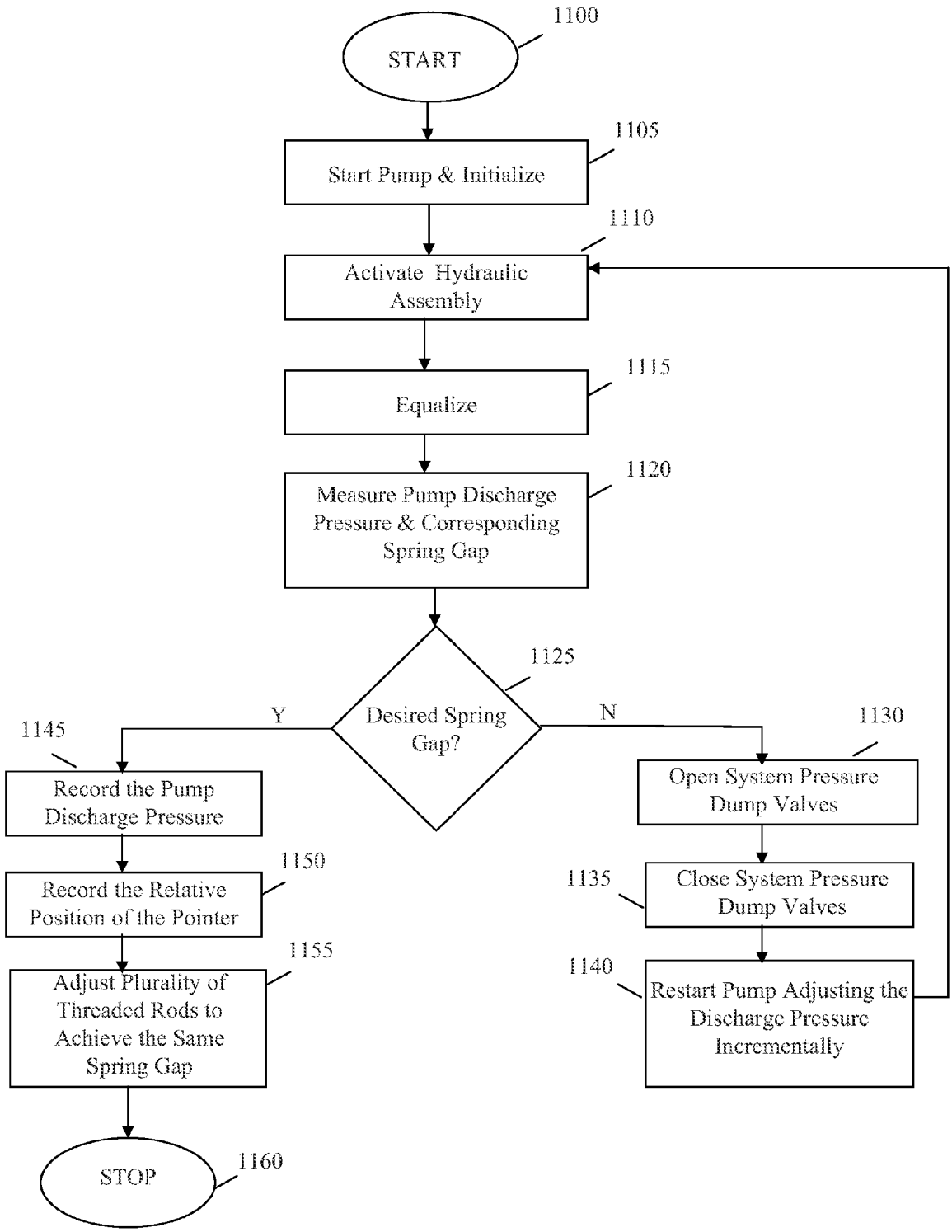
FIG. 11 is a flow diagram showing steps of an embodiment for a process performed according to principles of the invention for determining a "desired" set pressure in order to achieve proper spring tension and gap using a hydraulic tension adjustment gauge, constructed according to principles of the invention.

FIG. 11 is a flow diagram showing steps of an embodiment for a process performed according to principles of the invention for determining a "desired" set pressure in order to achieve proper spring tension and gap using a hydraulic tension adjustment gauge, constructed according to principles of the invention, starting at step 1100. The system of FIGS. 10A-10U, for example, may be employed in conjunction with these exemplary steps.

At step 1105, a hydraulic pump may be started, and set the discharge pressure initially to approximately 100 psi below the expected operating pressure, for example; the operating pressure may be approx. 850 psi. At step 1110, the hydraulic assembly may be activated. At step 1115, the pump discharge pressure gauge (e.g., gauge 1025) and system pressure gauge (e.g., gauge 1055) should be allowed to equalize. At step 1120, measure and record the pump discharge pressure and the corresponding spring gap. At step 1125, a check may be made. If the measured pressure has resulted in the desired spring gap (e.g., gap 1080), proceed to step 1145. However, if not, at step 1130, open the top and bottom system pressure dump valves allowing system pressure to decay to 0 psi. At step 1135, close the system pressure dump valves. At step 1140, restart the pump adjusting the discharge pressure incrementally, as follows, and as appropriate to achieve desired spring gap: increase pump discharge to decrease spring gap, or decrease pump discharge pressure to increase spring gap. The process may continue at step 1110.

At step 1145, record the pump discharge pressure which resulted in the proper tensioning of the compression spring (i.e., the "desired" pressure). At step 1150, record the relative position of the pointer on the linear scale. At step 1155, manually adjust one or more of a plurality of threaded rods to achieve the same spring gap in the plurality of corresponding compression springs as the spring gap of the single compression spring during the preceding portion of the process. At step 1160, the process ends.

Figure 12:
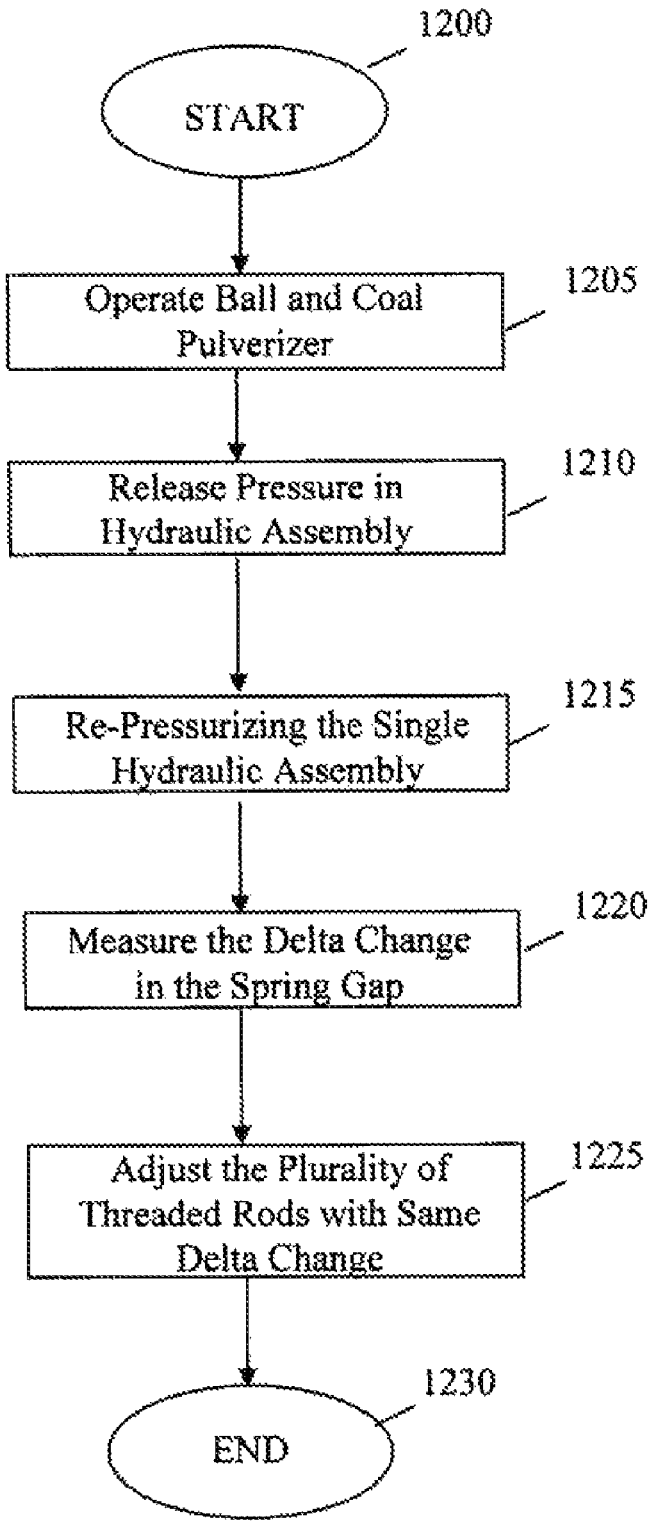
FIG. 12 is a flow diagram showing steps of a process for adjusting the load on a grinding ring and grinding ball(s) of a coal pulverizer, performed according to principles of the invention.

FIG. 12 is a flow diagram showing steps of a process for adjusting the load on a grinding ring and grinding ball(s) of a coal pulverizer, performed according to principles of the invention, starting at step 1200. At step 1205, a ball and coal pulverizer may be operated for a predetermined period of time. At step 1210, pressure in the single hydraulic assembly (e.g., hydraulic assembly 212) may be released. At step 1215, the single hydraulic assembly (e.g., hydraulic assembly 212) may be re-pressurized to achieve a predetermined or desired pressure. At step 1220, the delta change in the spring gap of the single compression spring may be measured to achieve the previous desired force by observing the delta change on a gauge or scale (e.g., scale 232) of the single hydraulic assembly. At step 1225, adjust a plurality of threaded rods (for one or more pulverizers, such as threaded rods 110) may be adjusted to the same delta change to achieve the predetermined or "desired" force on all the threaded rods. At step 1230, the process may end.

Figure 13A:
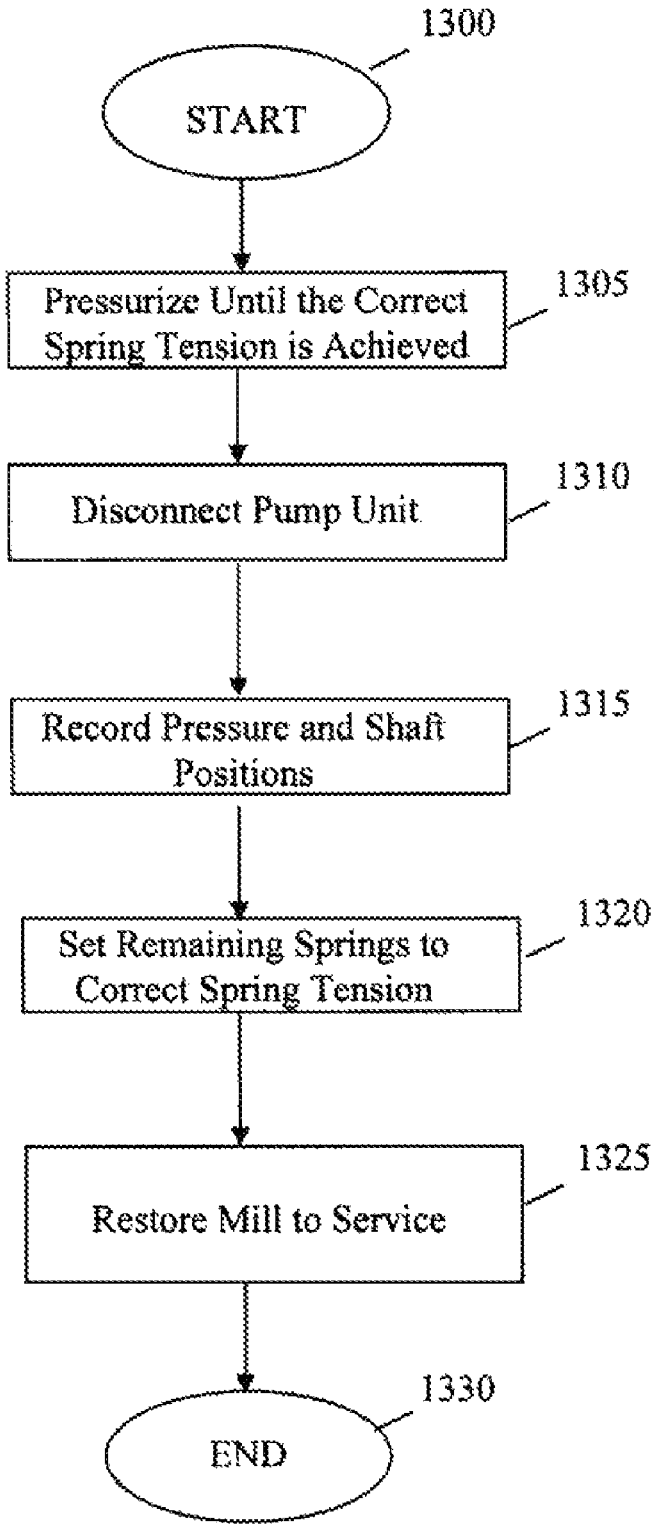
FIG. 13A is flow diagram of an embodiment showing steps of a process for initial setting of spring tension associated with a pulverizer, performed according to principles of the invention.

FIG. 13A is flow diagram of an embodiment showing steps of a process for initial setting of spring tension associated with a pulverizer, performed according to principles of the invention, starting at step 1300. At step 1305, the system may be pressurized until the "desired" or "predetermined" spring tension is achieved. At step 1310, the pump unit may be shut off, perhaps disconnected from the system. At step 1315, the (cylinder) pressure and relative shaft positions may be recorded (e.g., by way of scale 232, for example). At step 1320, any remaining springs may be manually set to "desired" or "predetermined" spring tension. At step 1325, the mill may be placed into service and run for a predetermined amount of time, or until readjustment of the spring(s) tension are deemed warranted. At step 1330, the process may end.

Figure 13B:
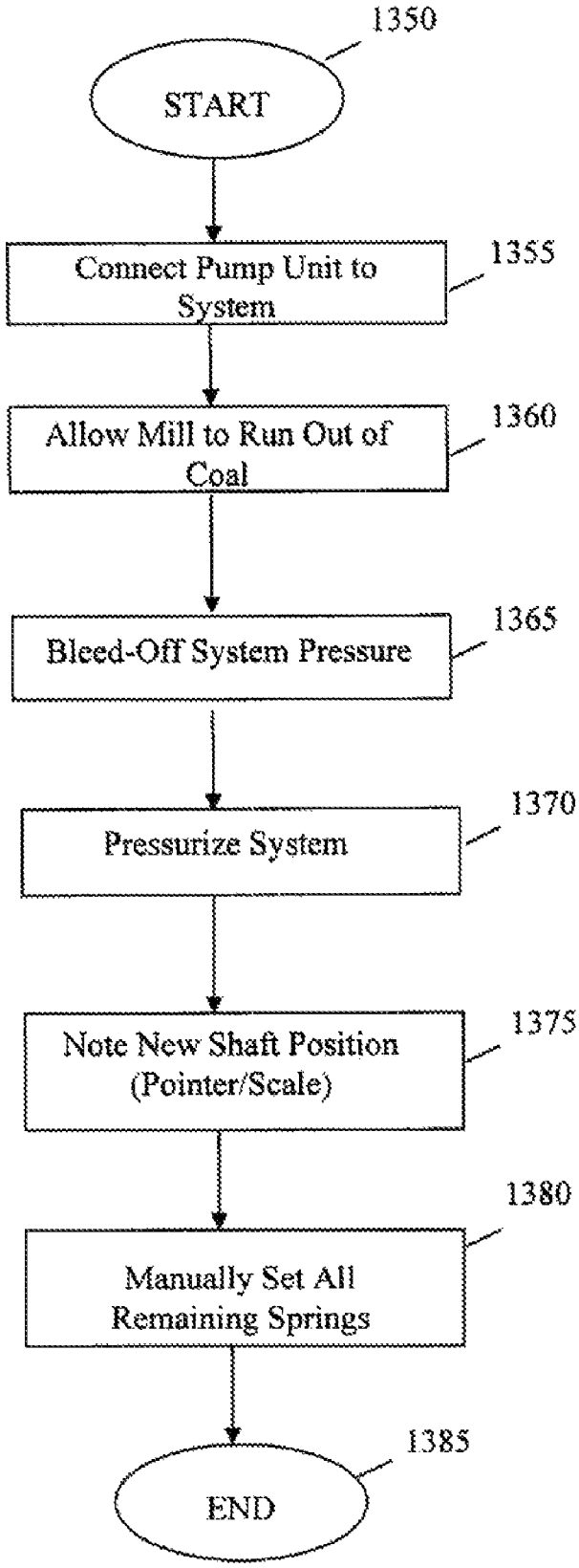
FIG. 13B is flow diagram of a process for resetting spring tension associated with a pulverizer, performed according to principles of the invention.

FIG. 13B is flow diagram of a process for resetting spring tension associated with a pulverizer, performed according to principles of the invention, starting at step 1350. At step 1355, the pump unit may be connected to the tension and adjustment gauge system (e.g., at 1015 and 1020 of FIG. 10A). At step 1360, the coal supply to the mill may be shut off and the mill allowed to "run dry" (i.e., run out of coal). At step 1365, the tension and adjustment gauge system pressure may be bled off of the hydraulic unit (e.g., 212) back to a reservoir tank, for example. At step 1370, the tension and adjustment gauge system may be pressurized to the original recorded pressure (i.e., a pressure that resulted in proper spring tension at set up). At step 1375, the new shaft position may be noted and recorded (e.g., via a reading of the pointer/scale 232). The shaft positions (e.g., per the pointer/scale 232) may be used to determine how much adjustment is needed for the remaining springs associated with the same pulverizer. At step 1380, all remaining springs may be manually set to calculated positions. At step 1385, the process may end.

A hydraulic fill procedure may be performed prior to the initial set procedure of FIG. 11. The procedure may be used to fill system with hydraulic oil and to bleed air from the system and may include providing fluid to the top of the cylinder, via the hydraulic pump. Once the cylinder reaches the bottom of its stroke any valves (e.g. valves 1060, 1070) between the cylinder (e.g., 212) and the head tank (e.g., 1110) may be opened. Opening these valve(s) (e.g. valves 1060, 1070) may allow trapped air to return to the head tank. Once it is determined that air is no longer present in the system, the initial set procedure may finish.

Figure 14:
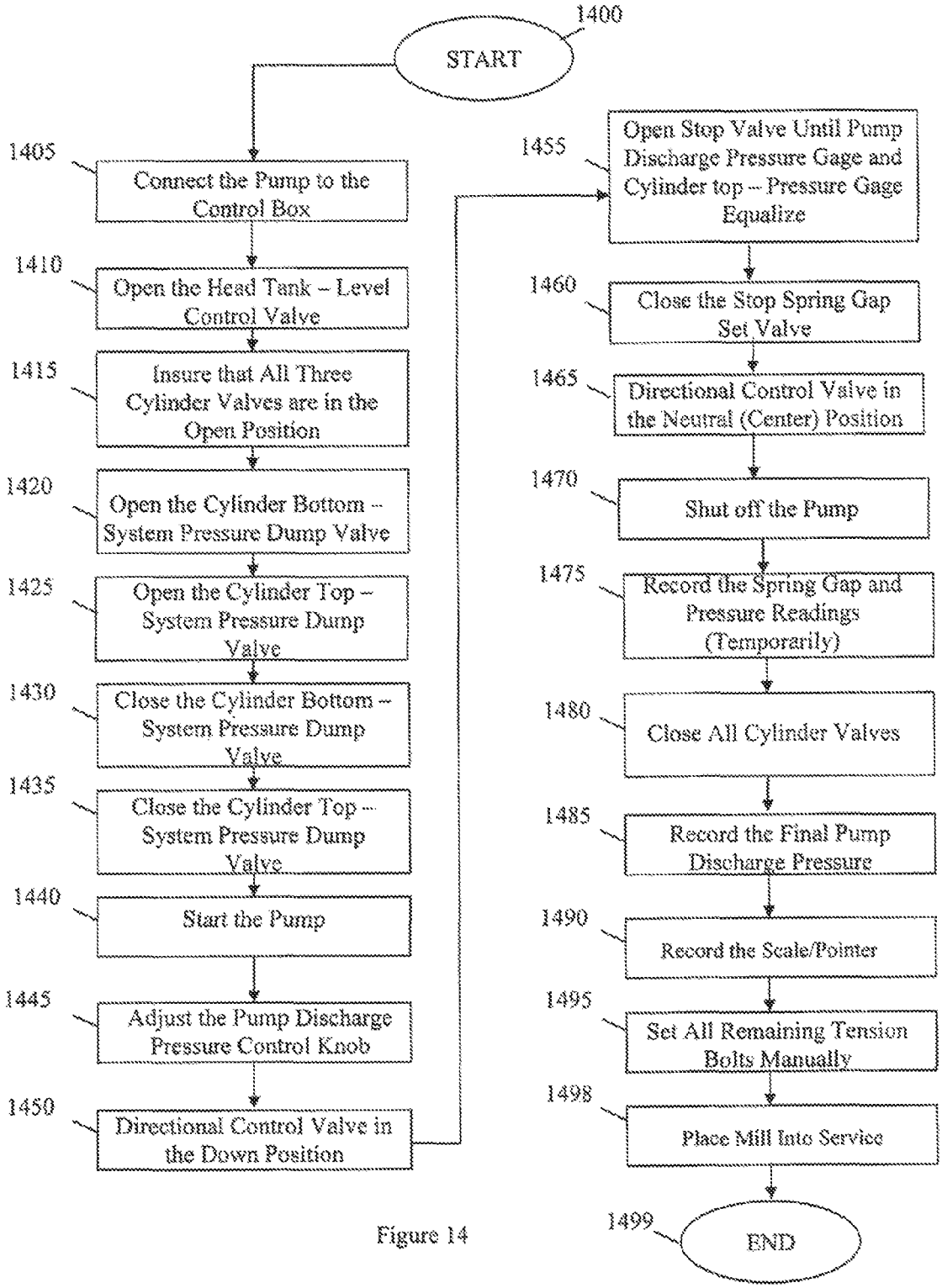
FIG. 14 is a flow diagram of a process for determining a pump discharge pressure needed to achieve a required spring gap and operation of an associated hydraulic tensioning device, performed according to principles of the invention

FIG. 14 is a flow diagram of a process for determining a pump discharge pressure needed to achieve a required spring gap and operation of an associated hydraulic tensioning device, performed according to principles of the invention, starting at step 1400. The steps for achieving the "required" spring gap (or spring tension) are exemplary, and may be implemented using a system such as described in relation to FIG. 7 through FIG. 10U, herein, for example. The pressure may differ from mill to mill due to variations inherent in the springs themselves, perhaps as much as 15%, or even more in some instances.

At step 1405, connect a hydraulic pump to a control box (e.g., control box 1005) via hydraulic quick connect couplings. At step 1410, a head tank level control valve (e.g., valve 1015) may be opened. The head tank level control valve should remain open during all filling and setting procedures to avoid overfilling and/or spillage. At step 1415, open (or assure they are open) all cylinder valves (e.g., valves 1065, 1070, 1075 of FIG. 10A). At step 1420, open a cylinder bottom pressure dump valve (e.g., valve 1045). At step 1425, open a cylinder top pressure dump valve (e.g., 1060). At step 1430, close the cylinder bottom pressure dump valve (e.g., valve 1045). At step 1435, close the cylinder top pressure dump valve (e.g., 1060). At this point, all valves within the control box (e.g., 1005) should be in the closed position and the directional control valve (e.g., 1035) should be in the neutral (usually in a center position, but can vary) position, i.e., closed.

At step 1440, the hydraulic pump (connected at step 1405) may be started. At step 1445, adjust the pressure (e.g., via pump discharge pressure control knob 1030) until the pump discharge control gauge (e.g., gauge 1025) reads approx. 500 psi. (initially), but could vary in different embodiments. At step 1450, the directional control valve (e.g., 1035) may be opened (usually in a down position, but can vary).

One or more of the following steps very likely may cause the cylinder and spring (e.g., spring 204) to travel. Therefore, personal should be clear of the cylinder/spring to avoid potential injury.

At step 1455, the stop valve 1050 may be opened until the pump discharge pressure gauge (e.g., gauge 1025) and the cylinder top pressure gauge (e.g., 1055) equalize. This may likely cause the cylinder or piston (e.g., piston 1076) to travel in the down direction and may cause the spring gap (e.g., gap 1080) to decrease. At step 1460, the spring gap set valve may be closed (i.e., after the pressure has equalized). At step 1465, the direction control valve (e.g., 1035) may be returned to the neutral (center) position. At step 1470, the pump may be shut off. At step 1475, the spring gap (e.g., recording a reading via scale 232) may be temporarily recorded and pressure readings recorded. This may also provide an operating pressure for use in the system.

If necessary, steps 1420 through 1465 may be repeated several times increasing the pump discharge pressure incrementally at step 1445, until the desired spring gap has been achieved. Moreover, once the desired spring gap has been achieved, optionally repeating steps 1420 through 1440 and steps 1450 through 1465 (skipping step 1445, leaving the discharge pressure constant) several times may be useful to assure repeatability. At step 1480, all cylinder valves (e.g., 1065, 1070 and 1075) may be closed. At step 1485, the final pump discharge pressure may be recorded (i.e., pressure required to achieve a repeatable spring gap setting). At step 1490, the scale/pointer (e.g., scale 232) reading may be recorded. At step 1495, all remaining tension bolts may be set manually, based on the recorded information. At step 1498, the mill may be placed back in service.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention. The spelling variations of gauge and gage are meant to be synonymous herein. Moreover, any document, publication or patent referred to herein is incorporated by reference in its entirety, or specific portions as stated.

I claim:

1. A ball and ring coal pulverizer, comprising:

a housing;

a stationary top grinding ring within the housing;

a lower grinding ring within the housing;

a plurality of grinding balls between the top grinding ring and the lower grinding ring;

an adjustable loading system for applying a compressive force exerted on the top grinding ring and grinding balls against the lower grinding ring, the adjustable loading system comprising:

a single hydraulic assembly mounted on the upper portion of the housing;

a gauge mounted proximate the hydraulic assembly for determining linear movement of a piston of the hydraulic assembly;

a plurality of threaded rods mounted to the upper portion of the housing capable of being manually adjusted;

the piston of the single hydraulic assembly passing through the upper portion of the housing to a compression spring connected to the top grinding ring;

the threaded rods passing through the upper portion of the housing to a plurality of compression springs, each compression spring connected between the threaded rods and the top grinding ring; and wherein movement of the piston corresponds to an equal distance of movement of a spring gap between an upper and lower portion of the compression spring, such that the gauge indicates the change in the spring gap by moving the piston.

2. The ball and coal pulverizer of claim 1, wherein the gauge comprises:

a pointer; and and a linear scale.

3. The ball and coal pulverizes of claim 2, wherein the pointer is mounted to the piston and the linear scale in mounted to a stationary portion of the single hydraulic assembly.

4. The ball and coal pulverizes of claim 2, wherein the linear scale is mounted to the piston and the pointer is mounted to a stationary portion of the single hydraulic assembly.

5. The ball and coal pulverizer of claim 2, wherein the linear scale is constructed to convey inches.

6. The ball and coal pulverizer of claim 1, wherein the lower grinding ring is configured as a rotating lower grinding ring.

7. The ball and coal pulverizer of claim 1, further comprising a control box connected to the single hydraulic assembly to control hydraulic pressure applied to the single hydraulic assembly.

8. A ball and ring coal pulverizer, comprising:

a top grinding ring within a housing;

a lower grinding ring within the housing;

a plurality of grinding balls between the top grinding ring and the lower grinding ring;

an adjustable loading system for applying a compressive force exerted on at least one of the top grinding ring and the lower grinding ring to apply pressure against the grinding balls, the adjustable loading system comprising:

a single hydraulic assembly proximate to one of the grinding rings;

a gauge mounted proximate the hydraulic assembly for determining linear movement of a piston of the hydraulic assembly;

a plurality of rods configured to be manually adjusted and located to apply pressure to at least one of the grinding rings; and the piston of the single hydraulic assembly configured to apply pressure to a compression spring connected to one of the grinding rings, wherein movement of the piston corresponds to an equal distance of movement of a spring gap between an upper and lower portion of the compression spring, such that the gauge indicates the change in the spring gap by moving the piston.

9. The ball and coal pulverizer of claim 8, wherein the gauge comprises:

a pointer; and and a linear scale.

10. The ball and coal pulverizer of claim 8, further comprising a housing to house at least the top grinding ring and the lower grinding ring.

11. The ball and coal pulverizer of claim 10, wherein the plurality of rods pass through the housing to a plurality of compression springs, each compression spring connected between one of the plurality of rods and one of the grinding rings.

12. The ball and coal pulverizer of claim 11, wherein the plurality of rods comprise a plurality of threaded rods.

13. The ball and ring coal pulverizer of claim 8, further comprising a control box interconnected with the single hydraulic assembly to control hydraulic pressure to the piston.

14. A system for adjusting the load on a grinding ring and grinding balls of a ball and coal pulverizer, the system comprising means for activating a single hydraulic assembly attached to a single compression spring on a grinding ring until a desired force is achieved;

means for determining a spring gap of the single compression spring corresponding to the desired force; and means for adjusting compression of a plurality of corresponding compression springs to achieve the spring gap in the plurality of corresponding compression springs as the spring gap of the single compression spring.

15. A method for adjusting the load on a grinding ring and grinding balls of a ball and coal pulverizer, the method comprising the steps of:

activating a single hydraulic assembly attached to a single compression spring on a grinding ring until a desired force is achieved for applying an operative pressure on the grinding balls;

determining the spring gap of the single compression spring corresponding to the desired force; and adjusting a plurality of rods attached to a plurality of corresponding compression springs to achieve the same spring gap in the plurality of corresponding compression springs as the spring gap of the single compression spring.

16. The method of claim 15, wherein the step of adjusting includes manually adjusting the plurality of rods.

17. The method of claim 15, wherein in the step for adjusting the plurality of rods includes adjusting a plurality of threaded rods.

18. The method of claim 15, wherein the step for activating includes activating the single hydraulic assembly with hydraulic pressure controlled from a control unit having at least one valve.

19. The method of claim 15, further comprising the steps of:

operating the ball and coal pulverizer for a period time;

releasing pressure in the single hydraulic assembly;

re-pressurizing the single hydraulic assembly to achieve the desired force;

measuring the delta change in the spring gap of the single compression spring to achieve the desired force by observing the delta change on a gauge of the single hydraulic assembly; and manually adjusting the plurality of rods by the same delta change to achieve the previous desired force on all the rods.

* * * * *